US005452056A

United States Patent [19]

Nomura et al.

[11] Patent Number: 5,452,056

[45] Date of Patent: Sep. 19, 1995

[54] IMAGE FORMING APPARATUS, PROCESS CARTRIDGE MOUNTABLE WITHIN IT AND METHOD FOR ATTACHING PHOTOSENSITIVE DRUM TO PROCESS CARTRIDGE

[75] Inventors: Yoshiya Nomura, Tokyo; Hiroo Kobayashi, Yokohama; Akira Higeta, Hiratsuka; Hironobu Isobe, Yokohama; Kazuo Shishido, Yokohama; Minoru Sato, Yokohama; Shigeo Miyabe, Yokohama; Koji Miura, Sagamihara, all of Japan

[73] Assignee: Canon Kabushiki Kaisha, Tokyo, Japan

[21] Appl. No.: 215,107

[22] Filed: Mar. 21, 1994

Related U.S. Application Data

[62] Division of Ser. No. 29,702, Mar. 11, 1993, Pat. No. 5,331,373.

[30] Foreign Application Priority Data

Mar. 13, 1992 [JP] Japan ..... 4-088284
Jun. 30, 1992 [JP] Japan ..... 4-173265

[51] Int. Cl.[6] ..... G03G 15/00

[52] U.S. Cl. ..... 355/200; 355/210; 355/211; 347/138; 347/140

[58] Field of Search ..... 355/200, 210, 211, 212; 346/160, 74 L

[56] References Cited

U.S. PATENT DOCUMENTS

| | | | |
|---|---|---|---|
| 3,536,397 | 10/1970 | Van Wagner | 355/211 |
| 4,040,157 | 8/1977 | Shanly | 355/211 |
| 4,105,345 | 8/1978 | Van Wagner | 355/211 |
| 4,120,576 | 10/1978 | Babish | 355/211 |
| 4,527,883 | 7/1985 | Kamiyama | 355/210 |
| 4,873,548 | 10/1989 | Kobayashi et al. | 355/200 |
| 4,922,297 | 5/1990 | Kondo | 355/211 |
| 4,952,989 | 8/1990 | Kawano et al. | 355/210 |
| 4,975,743 | 12/1990 | Surti | 355/211 |
| 5,023,660 | 6/1991 | Ebata et al. | 355/200 |
| 5,105,221 | 4/1992 | Takahashi et al. | 355/210 |
| 5,115,272 | 5/1992 | Ohmori et al. | 355/200 |
| 5,128,715 | 7/1992 | Furuyama et al. . | |
| 5,132,728 | 7/1992 | Suzaki et al. | 355/211 |
| 5,136,333 | 8/1992 | Craft et al. | 355/211 |
| 5,313,255 | 5/1994 | Taniguchi et al. | 355/211 |
| 5,331,373 | 7/1994 | Nomura et al. | 355/200 |
| 5,347,343 | 9/1994 | Ohtsuka et al. | 355/211 |

*Primary Examiner*—R. L. Moses
*Attorney, Agent, or Firm*—Fitzpatrick, Cella, Harper & Scinto

[57] ABSTRACT

In order to prevent the eccentricity of a rotary shaft for rotatably supporting an image bearing member used with an image forming apparatus when the image bearing member is rotated, a projection is provided on an outer peripheral surface of the rotary shaft fitted into a fitting hole formed in a casing for securing the rotary shaft.

31 Claims, 20 Drawing Sheets

IMAGE FORMING APPARATUS, PROCESS CARTRIDGE MOUNTABLE WITHIN IT AND METHOD FOR ATTACHING PHOTOSENSITIVE DRUM TO PROCESS CARTRIDGE

This application is a division of application Ser. No. 08/029,702 filed Mar. 11, 1993, U.S. Pat. No. 5,331,373.

BACKGROUND OF THE INVENTION

1. Field of the Invention

The present invention relates to an image forming apparatus such as a copying machine, a printer and the like, a process cartridge mountable within such image forming apparatus, and a method for attaching a photosensitive drum to such process cartridge.

2. Related Background Art

In a conventional process cartridge, as shown in FIG. 32, a photosensitive drum is attached to arm portions 141, 142 extending from a cleaner container 140 via support pins 143, 144. The support pins 143, 144 are fitted into holes formed in gear flanges 146, 147 secured to both ends of the photosensitive drum 145 by adhesive. When the process cartridge is mounted within an image forming apparatus, the gear flange 146 is meshed with a drive gear (not shown) of the image forming apparatus, so that the photosensitive drum 145 can be rotated in a predetermined direction at a predetermined number of revolutions. The support pins 143, 144 are secured in holes formed in the arms 141, 142 of the cleaner container 140 via screws.

However, in the above conventional process cartridge, due to the combination of the play between the holes of the cleaner container 140 and the support pins and the play between the support pins and the holes of the gear flanges, it was feared that a rotary axis of the photosensitive drum was deviated from a designed value or set value. Particularly, when the driving force is transmitted from the drive gear of the image forming apparatus to the flange gear, the photosensitive drum is displaced in a direction inclined by a angle corresponding to an pressure angle regarding a tangential line on base pitch circles of the drive gear and the flange gear, with the result that the light image of an original and the laser beam are incident to the photosensitive drum obliquely with respect to the axial direction of the drum, thereby worsening the perpendicularity of an image.

To avoid this, conventional rolling bearings are may be used. However, since such rolling bearing is expensive, it is not desirable to use the roller bearings with a process cartridge having a limited service life.

Alternatively, it is considered that the support pins are completely press-fitted into the holes of the cleaner container. In this case, however, since there arise the problems in manufacturing, that the assembling operability is worsened and that the photosensitive drum of a process cartridge which did not pass muster cannot be exchanged, it is difficult to utilize such a press-fit technique practically.

In particular, recently, since the image obtained by the image forming apparatus has been finer and more accurate, and the resolving power of the image is also improved, even a slight deviation and/or vibration of the rotary shaft of the photosensitive drum cause a serious problem.

SUMMARY OF THE INVENTION

Accordingly, an object of the present invention is to prevent a rotary shaft for rotatably supporting an image bearing drum from becoming eccentric.

Another object of the present invention is to provide a process cartridge wherein support pins for rotatably supporting an image bearing member can easily be secured in fitting holes formed in a casing of the process cartridge.

A further object of the present invention is to provide a process cartridge comprising a frame, fitting holes formed in the frame, an image bearing member, process means for acting on the image bearing means, support pins fitted into the fitting holes and adapted to rotatably support the image bearing member, and a projection formed on at least one of an outer peripheral surface of each support pin and an inner peripheral surface of each fitting hole.

A still further object of the present invention is to provide an image forming apparatus comprising a mounting means capable of mounting a process cartridge including a frame, fitting holes formed in the frame, an image bearing member, process means for acting on the image bearing means, support pins fitted into the fitting holes and adapted to rotatably support the image bearing member, and a projection formed on at least one of an outer peripheral surface of each support pin and an inner peripheral surface of each fitting hole; a driving force transmitting means for transmitting a driving force to the image bearing member of the process cartridge mounted on the mounting means; and a convey means for conveying a recording sheet.

A further object of the present invention is to provide a method for assembling a photosensitive drum, wherein support pins for a photosensitive drum and each having a projection at its outer peripheral surface are forcibly fitted into fitting holes formed in a frame, thereby rotatably supporting the photosensitive drum by the frame via the support pins.

A still further object of the present invention is to provide an image forming apparatus comprising a frame, fitting holes formed in the frame, a rotary member, support pins fitted into the fitting holes and adapted to rotatably support the rotary member, a projection formed on at least one of an outer peripheral surface of each support pin and an inner peripheral surface of each fitting hole, a driving force transmitting means for transmitting a driving force to the rotary member, and a convey means for conveying a recording sheet.

A further object of the present invention is to provide a process cartridge wherein a plurality of projections are formed on an outer peripheral surface of a rotary shaft which rotatably supports an image bearing drum and which is contacted with fitting holes formed in a casing of the process cartridge, in order to prevent the eccentricity of the rotary shaft due to the rotation of a gear of an image forming apparatus when the process cartridge is mounted within the image forming apparatus.

Other objects of the present invention will be apparent from the following description referring to the accompanying drawings.

DETAILED DESCRIPTION OF THE PREFERRED EMBODIMENTS

The present invention will now explained with reference to the accompanying drawings.

Figure 1:
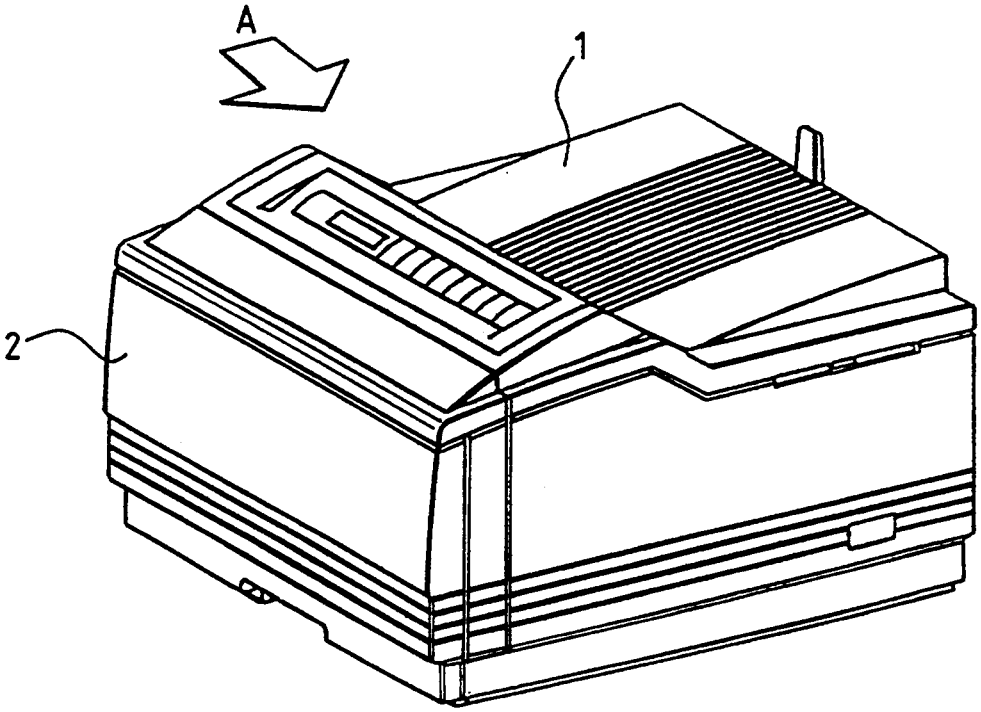
FIG. 1 is a perspective view of an image forming apparatus according to a preferred embodiment of the present invention.
Figure 2:
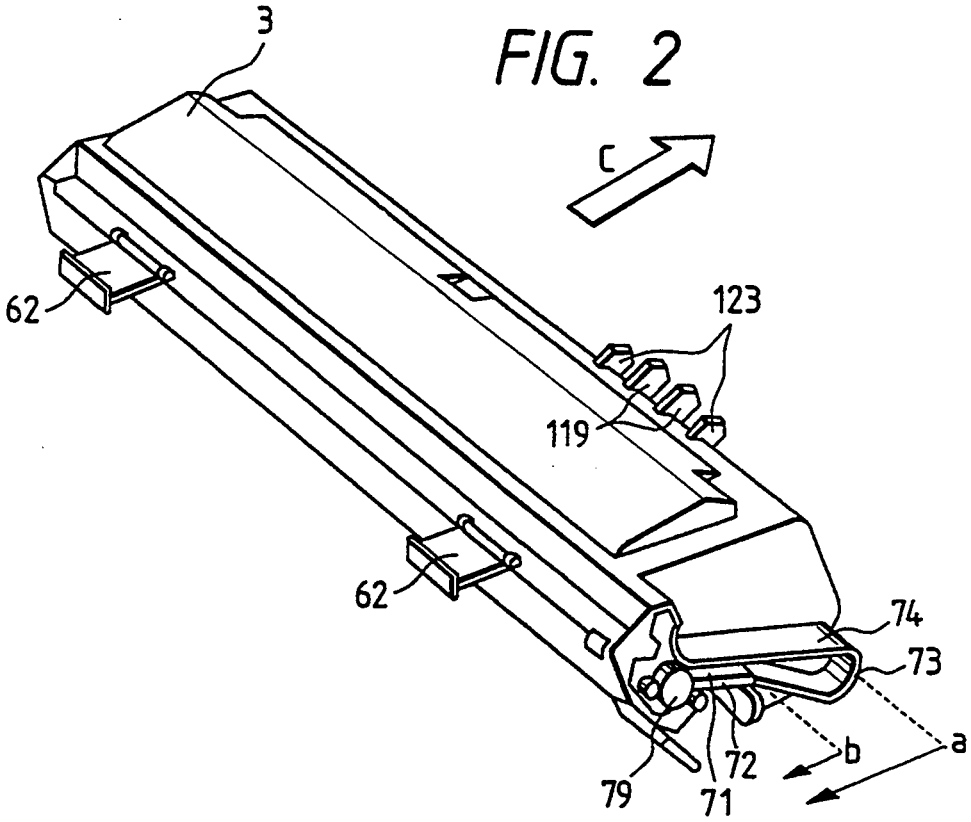
FIG. 2 is a perspective view of a process cartridge according to a preferred embodiment of the present invention.

FIG. 1 is a perspective view of a laser beam printer 1 as an example of an image forming apparatus according to a preferred embodiment of the present invention, and FIG. 2 is a perspective view of a process cartridge 3 according to a preferred embodiment of the present invention, which can be removably mounted within the printer 1 after a front door 2 of the printer is opened. The cartridge 3 includes therein a photosensitive member as an image bearing member, a charger means for uniformly charging the image bearing member, a developing means for developing a latent image formed on the image bearing member, and a cleaning means for removing the residual matter remaining on the image bearing member. Now, the process cartridge may include the image bearing member (photosensitive member), and at least one of the charger means, developing means and cleaning means as a unit which can be removably mounted within the image forming apparatus.

Figure 3:
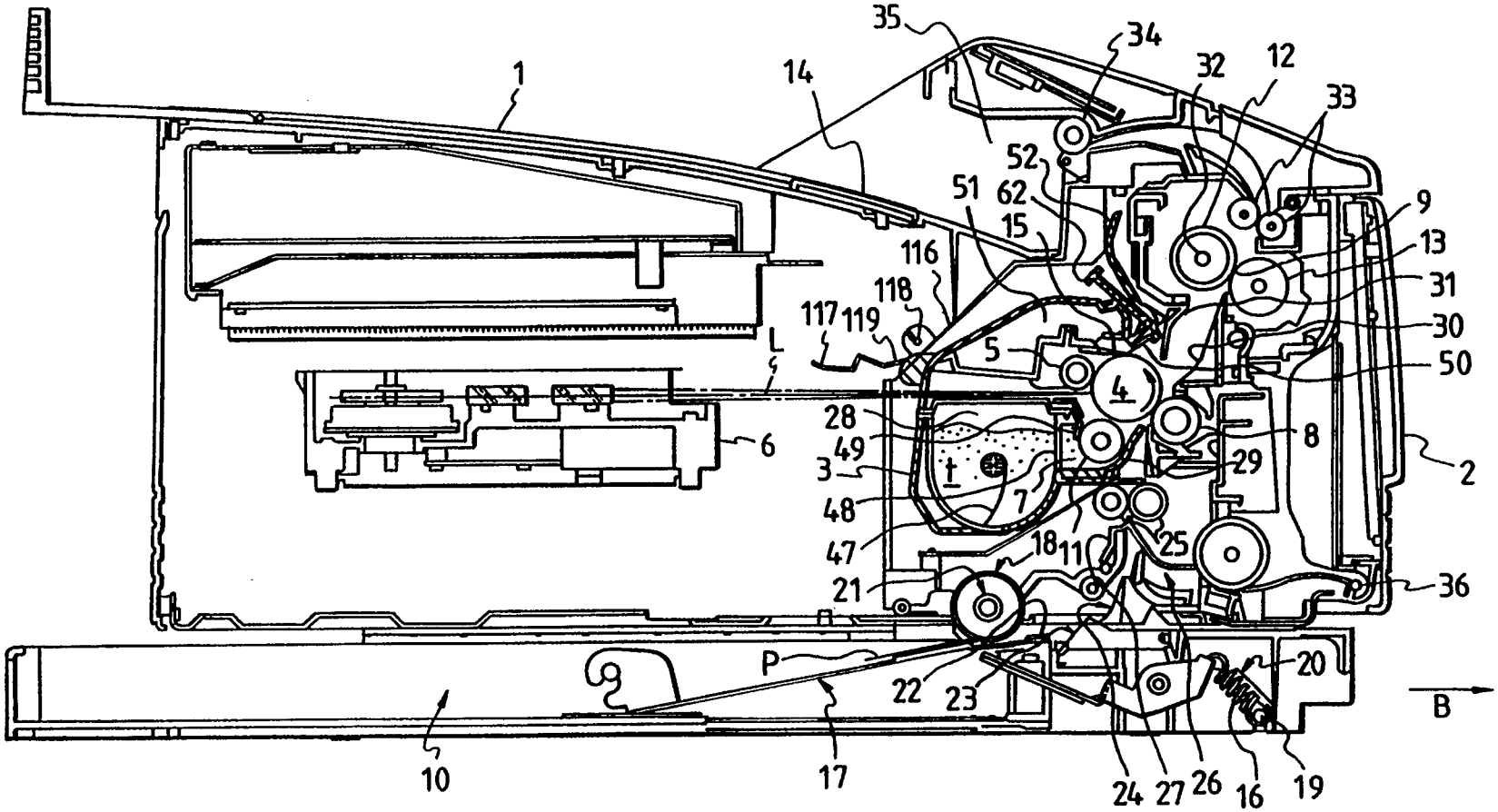
FIG. 3 is a sectional view of the image forming apparatus within which the process cartridge is mounted.
Figure 4:
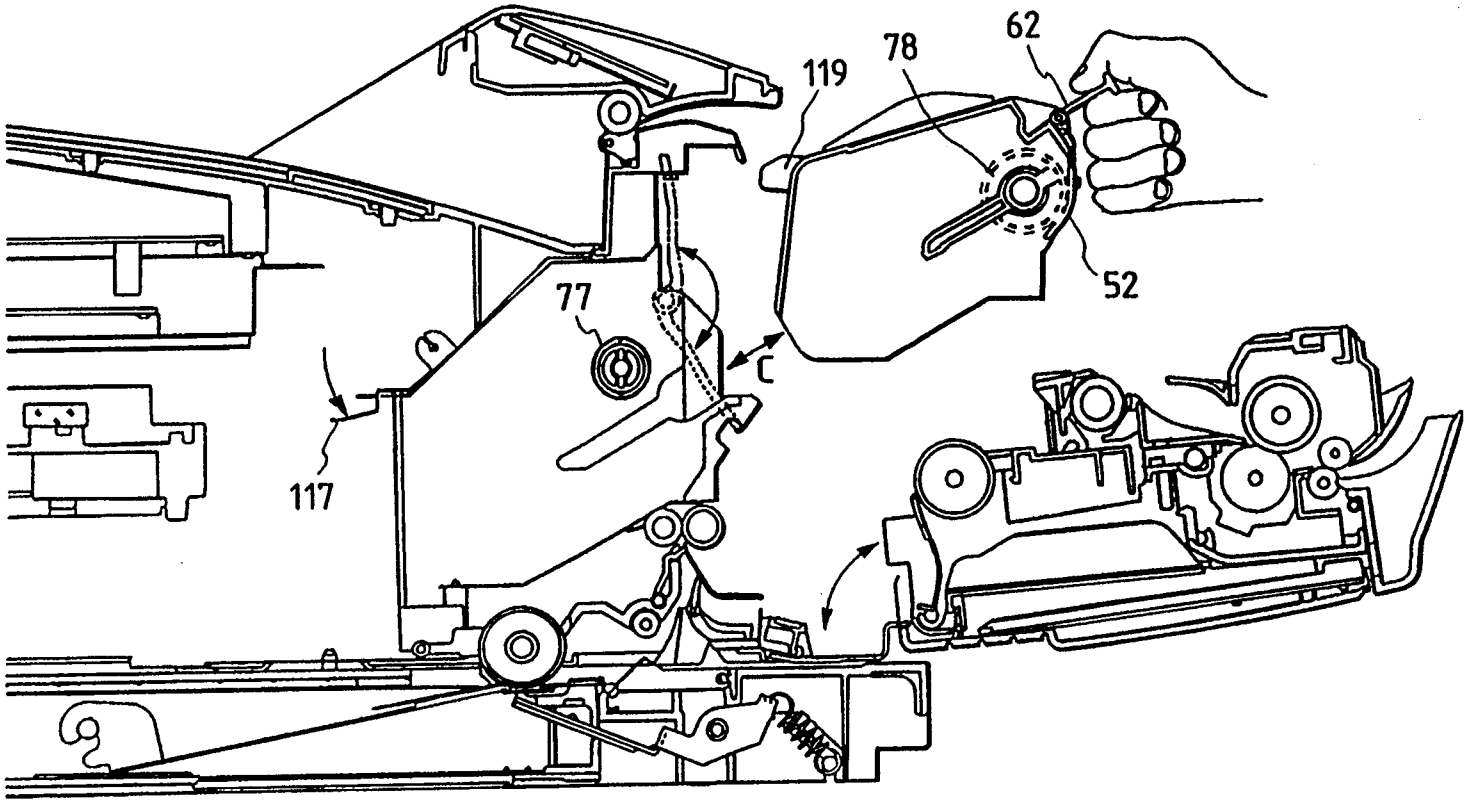
FIG. 4 is a view showing a condition that the process cartridge is being mounted within the image forming apparatus.

FIG. 3 is a sectional view (looked at from a direction shown by the arrow A in FIG. 1) of the printer 1 after the process cartridge 3 was mounted therewithin, and FIG. 4 is a sectional view showing the condition of the cartridge 3 being mounted and dismounted with respect to the printer after the front door 2 was opened. Incidentally, in FIG. 3, a frame of the cartridge 3 is shown as a hatched section.

First of all, an image forming process of the printer will be briefly described with reference to FIG. 3.

A photosensitive drum 4 having a photosensitive layer thereon is uniformly charged by a charger roller 5, and then, laser beams L from an optical laser unit 6 are illuminated on the photosensitive drum 4 in response to image information emitted from an external computer and the like. Consequently, an electrostatic latent image corresponding to the image information is formed on the photosensitive drum 4. Then, a developing device 7 develops (reverse or inversion development) the latent image (portion illuminated by the laser beams L) by applying to it toner having the same polarity as that of the latent image, thereby forming a visualized image on the photosensitive drum 4.

Then, in registration with the arrival of the visualized image to a transfer station between the photosensitive drum 4 and a transfer roller 8, a recording sheet P supplied from a sheet supply cassette 10 is pinched between the photosensitive drum 4 and the transfer roller 8, thereby transferring the visualized image onto the recording sheet P. Then, the recording sheet is sent to a nip between a pair of fixing rollers 12, 13, where the visualized image is fixed to the recording sheet P. Thereafter, the recording sheet P is discharged onto a discharge tray 14. After the transferring operation, the foreign matter such as the residual toner remaining on the photosensitive drum 4 is removed by a cleaning blade 15, thereby preparing for the next image formation.

Next, a feeding process for the recording sheet P will be described.

A plurality of recording sheet P are stacked in the sheet supply cassette 10, and an upper front portion of the sheet stack P is urged against a sheet supply roller 18 by a pivotal stacking plate 17 biased by tension springs 16. When an operator loads the recording sheets P in the cassette, he may draw or extract the sheet supply cassette 10 to the right in FIG. 3 (shown by the arrow B). In this case, since sheet supply spring pins 19 are shifted upwardly along guide grooves 20 formed in both side walls (this side and that side in FIG. 3) of the sheet supply cassette 10, the stacking plate 17 is lowered up to the bottom of the sheet supply cassette 10, thereby permitting the smooth loading of the recording sheets P.

The sheet supply roller 18 is secured to a sheet supply drive shaft 21, and a clutch and a solenoid (both not shown) are arranged at an end of the drive shaft 21, thereby permitting the rotation drive control for the sheet supply roller 18. Separating pawls or claws 22 are disposed above the left and right front corners of the sheet stack P, and a cassette inlet guide 23 arranged in the vicinity of a leading end of the sheet stack is rotatably biased by a spring (not shown). Further, a guide portion 24 for guiding the recording sheet from the sheet supply cassette 10 is formed on the printer 1, which guide portion serves to guide the recording sheet to direct it to a pair of regist rollers 25.

In response to a sheet supply start signal, when the solenoid (not shown) is turned ON, a driving force of a sheet supply drive gear is transmitted to the drive shaft 21 through the clutch (not shown), thereby rotating the sheet supply roller 18 to guide the recording sheet P to the cassette inlet guide 23. In this case, due to the coefficient of friction, only an uppermost recording sheet is picked up from the sheet stack. Immediately after, the recording sheet P is sent to a nip between the paired regist rollers 25 by the rotation of the sheet supply roller 18.

On the other hand, the printer is provided with a second inlet 26 for receiving a recording sheet P supplied from any means other than the sheet supply cassette 10 and for directing such recording sheet to the regist rollers 25. With this arrangement, it is possible to arrange a plurality of decks or sheet supply cassettes at a lower portion of the printer or to introduce the recording sheet P into the printer from the other means, thereby providing a printer having excellent versatility.

At an upstream side of the regist rollers 25 in a sheet feeding direction, there is disposed a sensor lever 27 which is pivotally mounted on a frame of the printer and serves to detect a leading end of the recording sheet P via a photo-interrupter and the line (not shown). After the leading end of the recording sheet is detected, the recording sheet P is sent to the nip between the photosensitive drum 4 and the transfer roller 8 by the regist rollers 25 in registration with a leading end of the visualized image formed on the photosensitive drum 4.

A plurality of longitudinal guide ribs (guide members) 29 are formed on a surface of a toner container 28 of the developing device 7, so that, when the recording sheet is fed, the ribs 29 serve to as guide members for the recording sheet, thereby feeding the recording sheet accurately with respect to the photosensitive drum 4. Thereafter, the visualized image (toner image) formed on the photosensitive drum 4 by the image forming process (fully described later) is transferred onto the recording sheet P by the transfer roller 8 urged against the photosensitive drum 4 with a predetermined pressure. In this case, a bias having a polarity opposite to that of the toner and having a voltage of about DC 500–2000 Volts is applied to the transfer roller 8, thereby electrostatically adhering the toner to the recording sheet P.

As an assist means for separating the recording sheet P from the photosensitive drum 4 after the transferring operation, a charge removing probe (not shown) is disposed at an upstream side of a fixing inlet guide 30, so that even the kind of sheet which is difficult to be separated can easily be separated from the drum smoothly. Accordingly, it is possible to prevent the entrainment of the recording sheet with the drum due to the poor separation of the recording sheet from the drum. Further, if the poor separation of the recording sheet from the photosensitive drum should occur, since a penetration preventing guide 31 is arranged in opposition to the fixing inlet guide 30, it is possible to avoid a serious jam of the recording sheet.

The recording sheet to which the toner image was transferred is sent to a fixing device 9. The fixing device 9 comprises the above-mentioned fixing roller 12 having a halogen heater (heat source) 32 therein, and the pressure roller 13 urged against the fixing roller 12 with a predetermined pressure. A temperature of the fixing roller 12 is detected by a thermistor (not shown) contacted with the surface of the fixing roller 12, and is controlled by a controller in an electric portion (not shown) of the printer. Further, in order to prevent the overdrive of the halogen heater 32, a thermo-switch of non-contact type (not shown) is arranged above the fixing roller 12.

While the recording sheet is being passed through the nip between the heated fixing roller 12 and the pressure roller 13, the toner image on the recording sheet P is permanently fixed to the recording sheet P. After the fixing operation, the recording sheet P is separated from the surface of the fixing roller 12 by a separation claw (not shown), and then is fed upwardly by a pair of pulling rollers 33. In this case, the pulling rollers 33 are rotated at a relative speed faster than the fixing roller 12 by a few percents, so that the recording sheet P is forcibly pulled and fed to prevent the curl and/or rumples of the recording sheet. Thereafter, the recording sheet P is ejected out of the printer by a pair of discharge rollers 34 and is discharged on the discharge tray 14 through an discharge opening 35. The above-mentioned transfer roller, fixing device, pulling rollers and the like are mounted on the front cover 2 which is pivotally supported by the frame of the printer via a shaft 36. The front cover 2 can be divided as shown in FIG. 4 and can be opened and closed with respect to the frame of the printer.

Figure 5:
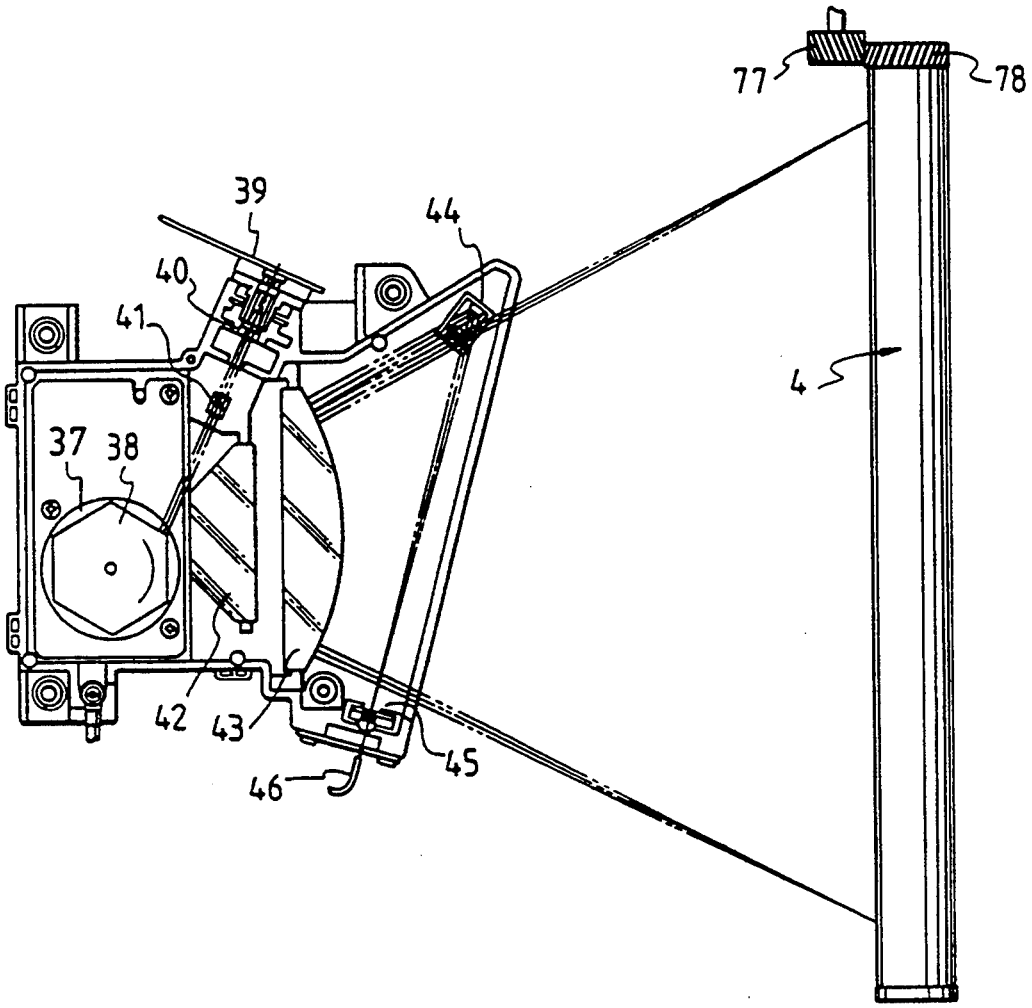
FIG. 5 is a view showing a laser scanner and laser beam paths.

Next, an optical laser system of an image forming portion will be explained with reference to FIGS. 3 and 5.

A rotatable polygon mirror 38 is secured to a rotary shaft of a polygon motor 37 which can be rotated at a high speed. The laser beams L emitted from a laser unit 39 pass through a collimater lens 40 and a cylindrical lens 41, and then are reflected by the polygon mirror 38 to reach a spherical lens 42, from which the laser beams are focused on the photosensitive drum 4 via an F$\theta$ lens 43.

The laser beams L are shifted along the generatrix of the photosensitive drum 4 by the rotation of the polygon mirror 38 to scan the drum, and the area illuminated by the focused point of the laser beams L is changed to a predetermined potential by the ON/OFF control of the laser unit 39, thereby forming the electrostatic latent image on the photosensitive drum 4. In this case, in order to provide the reference of the laser scan along the generatrix of the photosensitive drum 4 (referred to as "main scan") effected by the polygon mirror 38, a BD mirror 44 is disposed out of a starting point (from which the main scan is started) of an image area. After the laser beams L are reflected by the BD mirror 44, they are directed to a laser receiving surface 45 disposed at a position substantially equivalent to the photosensitive drum 4. Thereafter, the laser beams L are directed to a laser receiving element (not shown) of a DC controller (not shown) by an optical fiber 46 disposed contiguous to the laser receiving surface 45.

With this arrangement, by detecting the beams, the reference timing of the laser scan can be obtained from the image output timing, and, by outputting image signals to the laser unit by clock on the basis of the reference timing, the scan is effected along the main scan direction. The optical elements such as the above-mentioned polygon motor, mirrors and lenses are contained together within the scanner unit 6 which is secured to the printer with high accuracy.

Next, the process cartridge 3 constituting the image forming portion will be explained.

When the process cartridge is inserted into the printer, the above-mentioned electrophotographic process is used as the image forming method. Now, the construction of the process cartridge 3 will be briefly described in accordance with this process.

A primary charger station is arranged at an upstream side of an exposure position where the drum is illuminated by the laser beams L, and, in the illustrated embodiment, this station includes the charger roller 5 as a rotatingly driven semi-conductive elastic member urged against the photosensitive drum 4 with a predetermined pressure. The charger roller 5 serves to uniformly charge the surface of the photosensitive drum, for example, with a voltage of −600 to −700 Volts by applying the bias of DC −600 to −700 Volts and AC 1200 to 1800 Volts.

Then, the electrostatic latent image is formed by the above-mentioned optical laser beam system, and the potential of the electrostatic latent image portion on the drum is changed to −50 to −150 Volts.

On the other hand, the toner having the same polarity as that of the primary charger is picked up from the toner container 28 by an agitating member 47 to be fed to the interior of the developing device 7 through an opening 48. The toner t frictionally charged by the friction between the toner and a developing blade 49 is coated on the developing roller 11 as a thin toner layer. The toner t is inversion-developed (jumping phenomenon) onto the surface of the photosensitive drum 4 in correspondence to the electrostatic latent image by applying a AC bias to the developing roller 11 spaced apart from the photosensitive drum 4 by a distance of 200 to 350 μm. Then, as mentioned above, the toner image on the photosensitive drum 4 is transferred onto the recording sheet P by the bias of the transfer roller 8.

On the other hand, the residual toner t remaining on the photosensitive drum 4 passes through below a dip sheet 50 (PET sheet having a thickness of 50 to 100 μm) disposed at an entrance of the cleaning device and is scraped by the cleaning blade 15 to be collected in a cleaning container 51. The cleaned photosensitive drum 4 can be used for the next image forming process again.

The process cartridge 3 is designed so that it is exchanged by a new one after a predetermined number of the image forming processes have been finished, in consideration of the service life of the process members (photosensitive drum, cleaning blade, charger roller and the like) and the consumption of toner. In exchanging the process cartridge, the process cartridge 3 can be extracted toward a direction in which the front cover 2 is opened. That is, when the front cover 2 is opened, the process cartridge 3 can be drawn in a direction perpendicular to the generatrix of the photosensitive drum 4. Further, after a new process cartridge 3 has been mounted within the printer, when the front cover 2 is closed, the process cartridge 3 is set at a predetermined position by the uring force of the transfer roller 8 and the like.

By the way, if the photosensitive drum 4 is exposed to the external light for a long time or if foreign matter is adhered to the surface of the photosensitive drum or if the photosensitive drum is damaged during transportation, a poor image will be formed. In the illustrated embodiment, as shown in FIGS. 1, 6 and 7, a drum shutter (cover) 52 movable between a first position where it covers an exposed portion of the photosensitive drum and a second position where it is retarded from the first position is rotatably supported by a frame or housing of the process cartridge 3. Incidentally, FIG. 6 shows a front view and a side view of the process cartridge wherein the drum shutter 52 is positioned at a front side, and FIG. 7 is a perspective view of the cartridge when the drum shutter 52 is opened.

In the condition in which the process cartridge is dismounted from the printer or in the condition in which the process cartridge is mounted within the printer and the front cover 2 is opened, the drum shutter 52 is closed (to the first position) by a biasing force of a shutter spring 53. A drum shutter pin 54 such as a rod-shaped arm is protruded from an end of the drum shutter 52, which pin is adapted to engage by a shutter open lever 55 of the printer. The shutter open lever 55 is rotatably mounted around a pivot 56 for pivotal movement synchronous with the opening/closing movement of the front cover 2. In the condition in which the process cartridge 3 is mounted within the printer, when the front cover 2 is closed, the shutter open lever 55 is rotated to engage by the shutter pin 54, thereby opening the drum shutter 54 (to the second position).

Incidentally, the drum shutter 52 is pivotally mounted around a rotary shaft 57 which is in turn rotatably supported by rotary supporting portions 58, 59 formed on both longitudinal ends of the cartridge. The rotary supporting portion 58 has a circular hole 60 for receiving the rotary shaft 57, and the other rotary supporting portion 59 has a slitted hole 61 for receiving the rotary shaft 57. When the drum shutter 52 having the rotary shaft 57 is attached to the frame of the process cartridge, one end of the rotary shaft 57 is firstly inserted into the circular hole 60, and then the other end of the rotary shaft 57 is inserted into the slitted hole 61 through the slit.

In this way, since one of the rotary supporting portions has the circular hole and the other rotary supporting portion has the slitted hole, it is possible to prevent the drum shutter 52 from dropping from the cartridge frame inadvertently and to facilitate the assembling of the drum shutter.

Figures 6A, 6B, 6C:
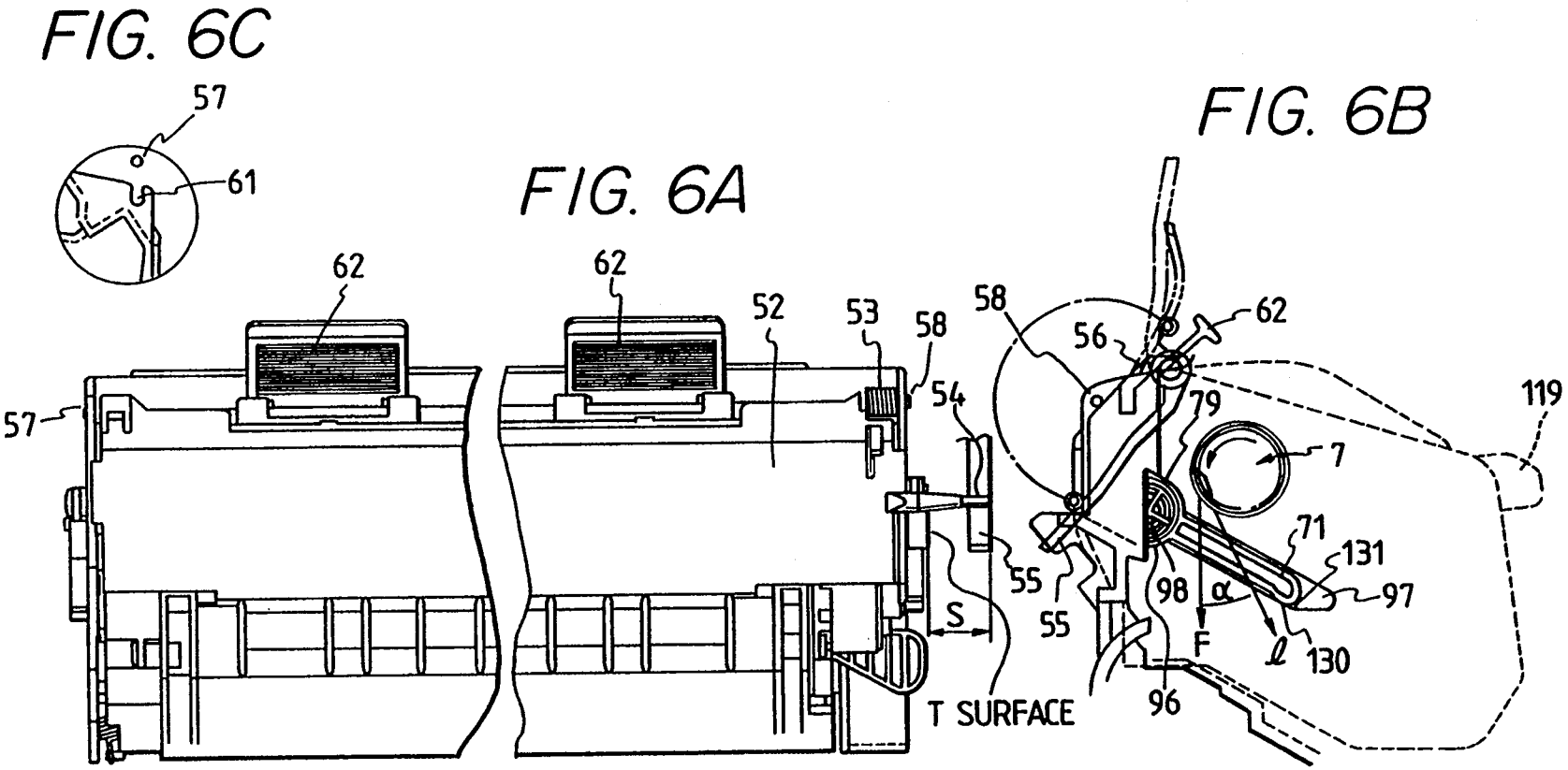
FIGS. 6A, 6B, and 6C show front, sectional, and detail views of the process cartridge.
Figure 7:
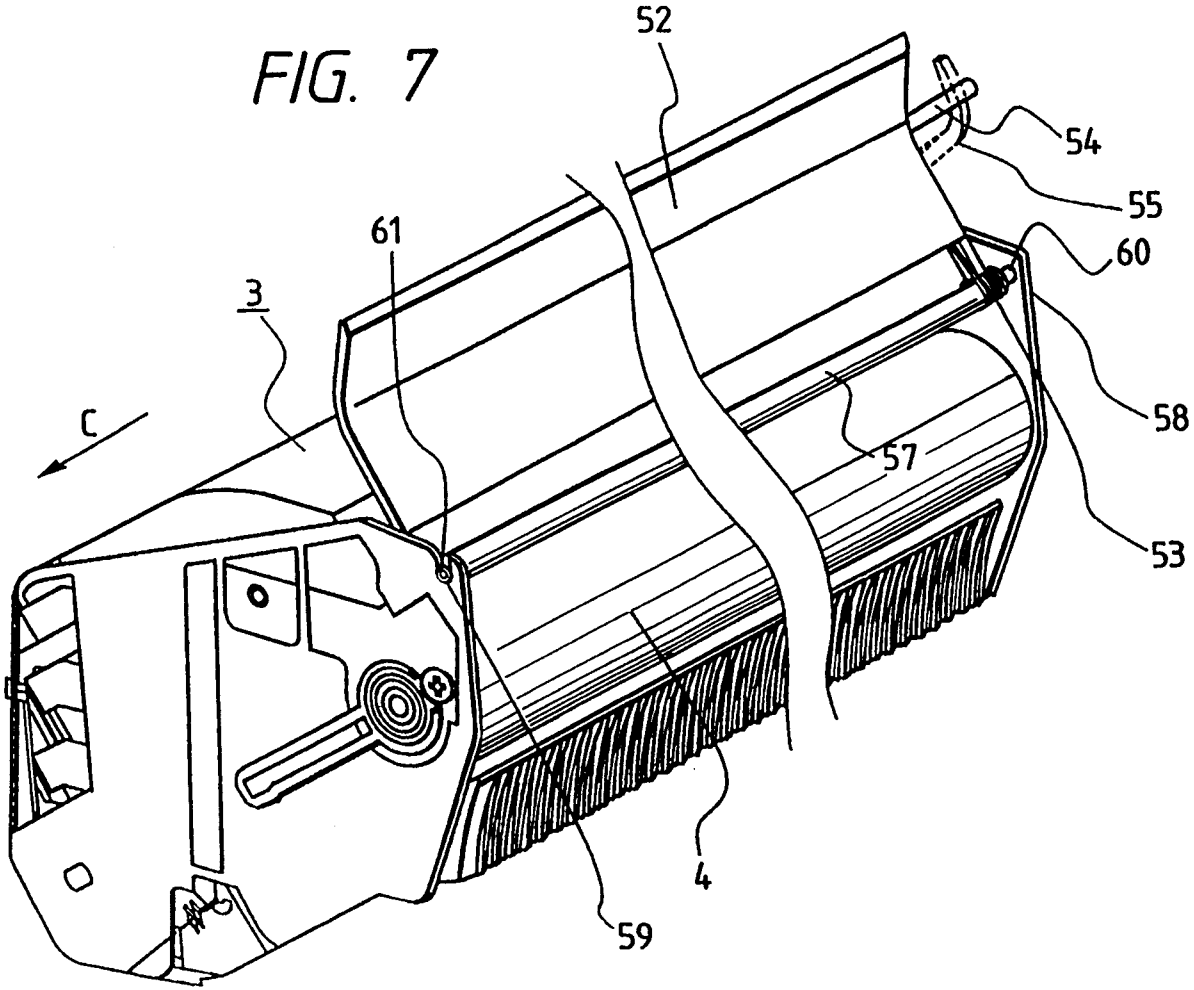
FIG. 7 is a perspective view of the process cartridge showing a condition that a drum cover is opened.
Figure 23:
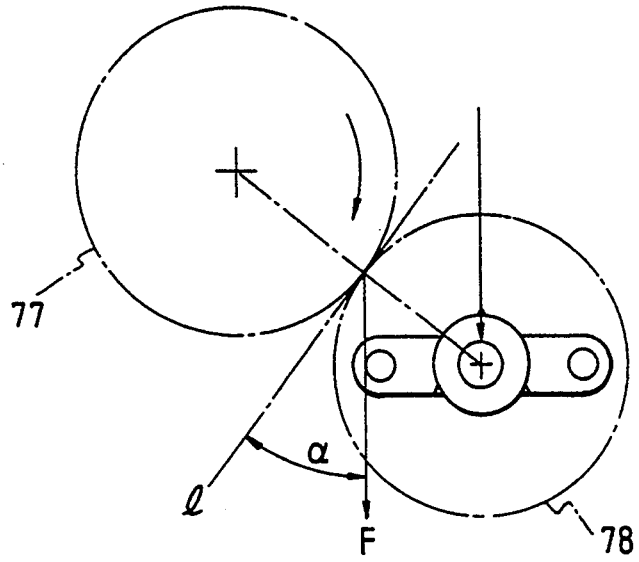

Particularly, as shown in FIGS. 6B and 23, a driving force receiving portion (second gear) provided at the end of the photosensitive drum and adapted to receive the driving force from the printer via a first driving force transmitting gear is subjected to a force F directed toward a direction inclined by an angle corresponding to the pressure angle with respect to a line l tangential to a pitch circle, due to the rotation of a first drive gear of the printer. Thus, when the circular hole 60 is positioned near the driving force receiving portion or second gear, if the force F acts on the drum shutter pin to disengage it from the cartridge, the drum shutter is not disengaged from the cartridge due to the existence of the circular hole.

Further, the drum shutter 52 is biased by the shutter spring 53 to be rotated toward one direction, which shutter spring is disposed near the drum shutter pin 54 and is mounted around the end of the shaft 57 near the circular hole 60. With this arrangement, in comparison with a case where the shutter spring is disposed at the opposite side (near the slitted hole 61), it is possible to greatly reduce the torsion amount of the drum shutter 52 when the drum shutter 52 is completely opened. Accordingly, it is possible to avoid the defects (interference between the parts and the plastic deformation) caused by the torsion of the drum shutter.

Further, in the illustrated embodiment, a length S of the drum shutter pin 54 of the drum shutter 52 is selected to protrude from a thrust reference surface T of the process cartridge by a distance smaller than 19 mm, so that the damage of a package bag for the process cartridge can be prevented. If the length S is greater than 19 mm ($S \geqq 19$ mm), as a result of the dropping test, it was found that the package material was damaged. In this case, the pin must be capped by a special packing, which leads to the cost-up.

In the illustrated embodiment, while the shafts were provided on both ends of the drum shutter, it should be noted that such shafts may be provided on the process cartridge and corresponding holes may be formed in the ends of the drum shutter, or any combination of shafts and pins may be adopted.

The mounting and dismounting of the process cartridge 3 with respect to the printer can be effected by an operator who grasps a grip member 62 provided on the frame of the process cartridge 3. The grip member 62 is pivotally mounted on the process cartridge 3 so that it can be pivoted synchronously with the pivotal movement of the drum shutter 52, thereby preventing the interference between the grip member and the process means in the printer. The operator holds the grip member 62 and sets or loads the process cartridge 3 in a cartridge setting position on a base in the printer. Such setting operation for the process cartridge can be effected correctly by using a positioning and guiding mechanism which will be described later.

Arcuated positioning flange portions 79, and guide rib portions 71 for preventing the inclination of the process cartridge 3 and for guiding the mounting of the process cartridge within the printer are formed on the frame of the process cartridge near both ends of the photosensitive drum. Further, the photosensitive drum 4 is supported, at both its longitudinal ends, by drum positioning pins 98 which are inserted and secured in positioning holes concentric with the arcuated flange portions 79. On the other hand, guide holes 97 for guiding the guide portions 71 and for regulating the inclination of the process cartridge 3, the arcuated positioning portions 96 for positioning the process cartridge 3 are provided in the printer.

In this way, by engaging the flange portions 79 of the process cartridge 3 with the positioning portions 96 of the printer, the photosensitive drum 4 is positioned with respect to the printer with high accuracy.

Accordingly, the operator can easily mount the process cartridge within the printer by inserting the guide ribs of the process cartridge 3 into the guide holes 97 of the printer and then pushing the cartridge toward the interior of the printer. Incidentally, as an auxiliary guiding means for assisting the mounting of the process cartridge, a mark (FIG. 12) is formed on a central portion of a top surface of the process cartridge and a corresponding mark (not shown) is formed on a central portion of an upper wall of the cartridge insertion opening of the printer. With this arrangement, by aligning these marks with each other, the mounting ability for the process cartridge is improved.

By the way, a laser shutter 117 is pivotally mounted on an inner cover 116 of the printer for pivotal movement around a hole 118. When the process cartridge 3 is not mounted within the printer, the laser shutter 117 is lowered by its own weight, thereby closing the laser beam paths (as shown in FIG. 4). Accordingly, if the laser beams should be emitted by an erroneous operation, the closed laser shutter prevents the laser beams from leaking out of the printer.

On the other hand, a laser shutter rib 119 for actuating the laser shutter 117 is provided on a rear portion of the frame of the process cartridge 3. When the process cartridge 3 is mounted within the printer, the laser shutter rib 119 pushes the laser shutter 117 upwardly (to the position shown in FIG. 3), thereby opening the laser beam paths.

Figure 32:
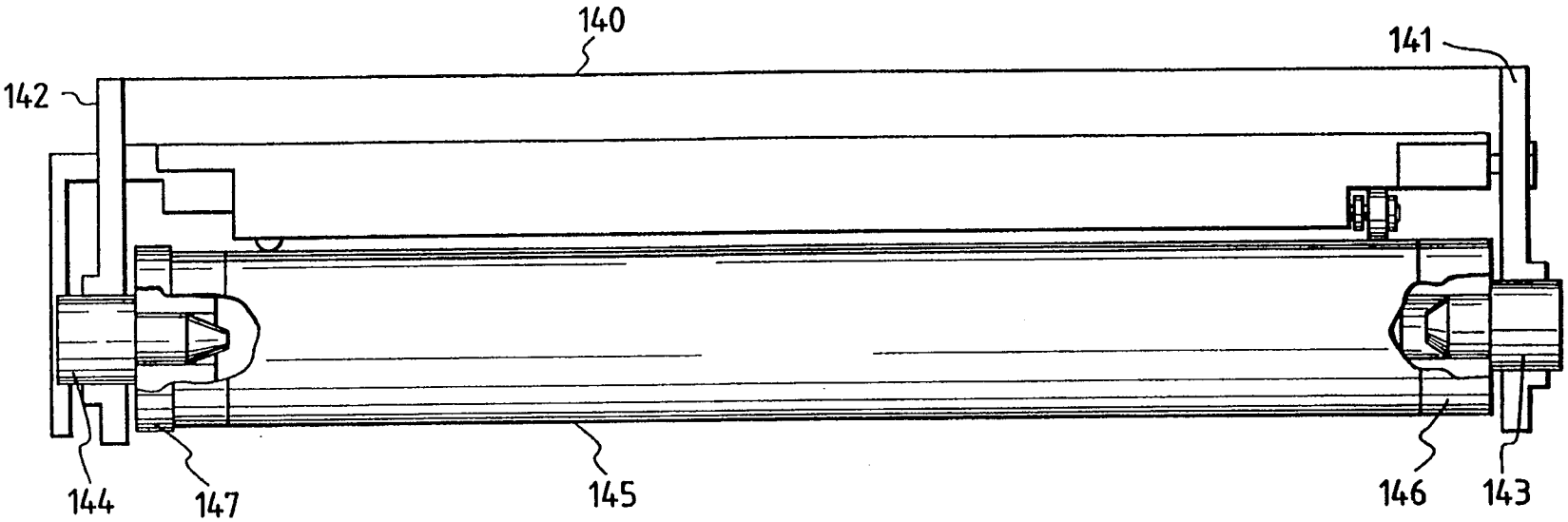
FIG. 32 is a partial sectional view of a conventional cartridge.

The photosensitive drum 4 is driven by a drive gear (first gear) 77 rotatably supported in the inner side wall of the printer and adapted to mesh with a drum gear (second gear) 78 secured to the end of the photosensitive drum 4. When the drive motor is rotated, the drum drive gear 77 is rotated via a motor gear, idler gears and clutch gear (all of them are not shown), and then the photosensitive drum 4 is rotated, thereby effecting the above-mentioned image forming operation. In this case, a direction of the meshing force F acting on the surface of tooth of the drum gear is deviated from a line Z perpendicular to a line connecting between rotational centers of the drum gear 78 and the drum drive gear 77, by an angle corresponding to the pressure angle $\alpha$, as shown in FIGS. 6B and 32. This direction of the meshing force F is oriented toward the mounting direction of the process cartridge within the printer.

Accordingly, when the drum drive gear 77 is rotated, the flange portions 79 of the process cartridge is urged against the positioning portions 96 of the printer by the meshing force F. Thus, if the flange portions 79 of the process cartridge should be supported offset from the positioning portions 96 of the printer, when the photosensitive drum 4 is driven, the flange portions 79 are positioned correctly.

Further, since anti-clockwise moment around the rotational center of the photosensitive drum 4 is generated in the process cartridge 3 due to the meshing force F, support surfaces 130 of the guide rib portions 71 are urged against receiving surfaces 131 of the guide holes 97 of the printer. Thus, if the support surfaces 130 of the guide rib portions 71 of the process cartridge should be supported to float from the receiving surfaces 131 of the guide holes 97 of the printer, when the photosensitive drum 4 is driven, the support surfaces 130 and the receiving surfaces 131 are closely contacted with each other, thereby providing the proper supporting condition.

When the process cartridge 3 is dismounted from the printer, the front cover 2 is opened. When the front cover is opened, the drum drive gear 77 is disengaged from gears connected to the drive motor, by a linkage mechanism (not shown), with the result that the drum drive gear is free from the gears of the printer. Accordingly, the above-mentioned meshing force F disappears, with the result that the process cartridge can be dismounted from the printer smoothly.

Figure 31:
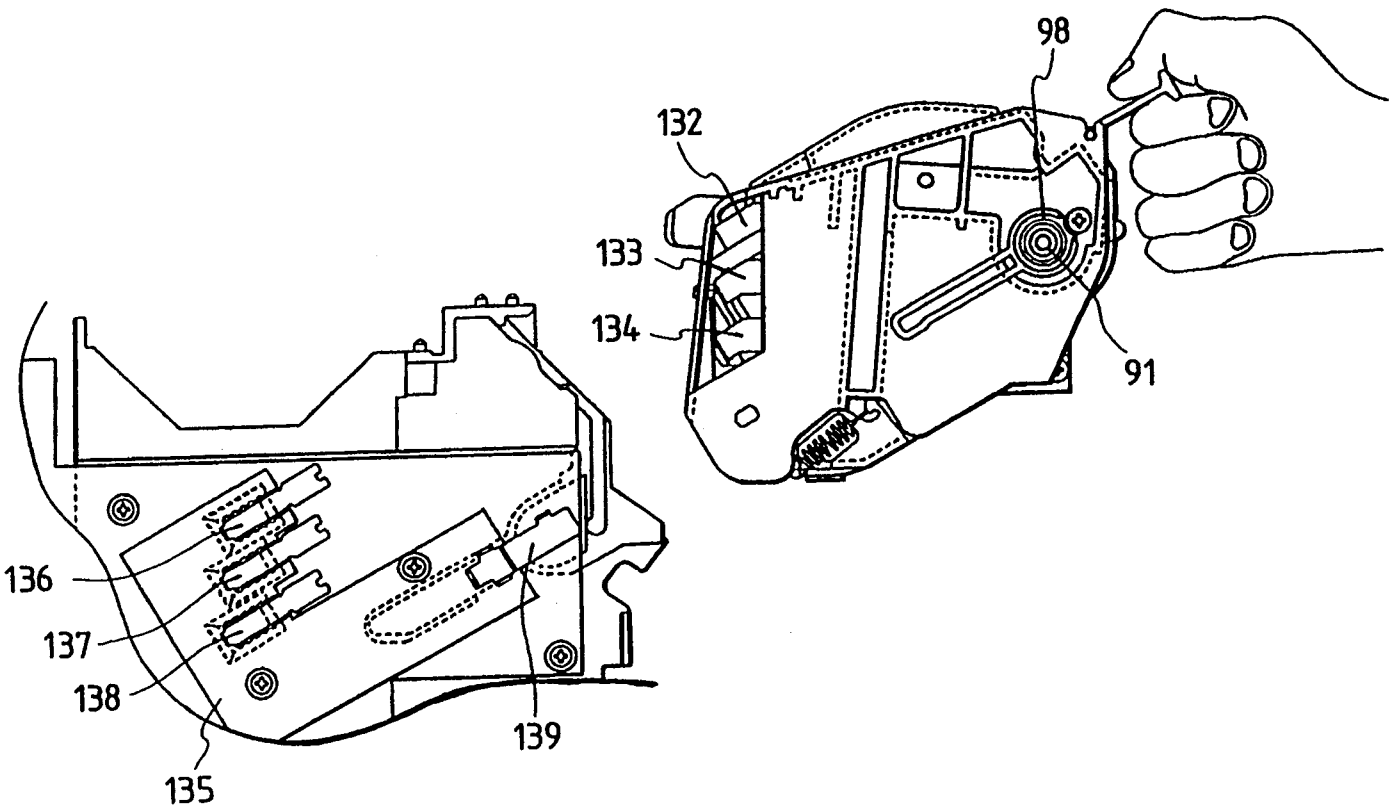
FIG. 31 is an explanatory view showing electric contacts of the cartridge and electric contacts of the image forming apparatus.

Next, the electric connection between the process cartridge 3 and the printer 1 will be described. As shown in FIG. 31, a primary bias contact 132, a developing bias contact 133 and a toner remaining amount detection contact 134 are arranged, at a predetermined interval, on a side surface of the process cartridge 3 opposite to the drum gear 78. Further, an electrode 91 for earthing the drum is protruded laterally from the drum positioning pin 98.

On the other hand, a high voltage substrate 135 is attached to the inner side wall of the printer, and a primary bias contact 136, a developing bias contact 137, a toner remaining amount detection contact 138 and a drum earthing contact 139 which are to be electrically connected to the process cartridge 3 are arranged on the high voltage substrate 135. When the high voltage substrate is attached to the printer, upper end portions of these contacts are protruded inwardly from holes formed in the side wall of the printer.

When the process cartridge is mounted within the printer, the corresponding contacts of the cartridge and the printer are electrically connected with each other, thus completing the electrical connection. It is desirable that the contacts of the process cartridge and the contacts of the printer are made of the same material or the material of same group. In the illustrated embodiment, each of the contacts formed on the high voltage substrate is made from bronze phosphide plate electroplated by KN, and each of the contacts (primary bias contact, developing bias contact and toner remaining amount detection contact) of the process cartridge is made from stainless steel plate, and the electrode for earthing the drum is made from a steel plate electroplated by KN.

Figure 8:
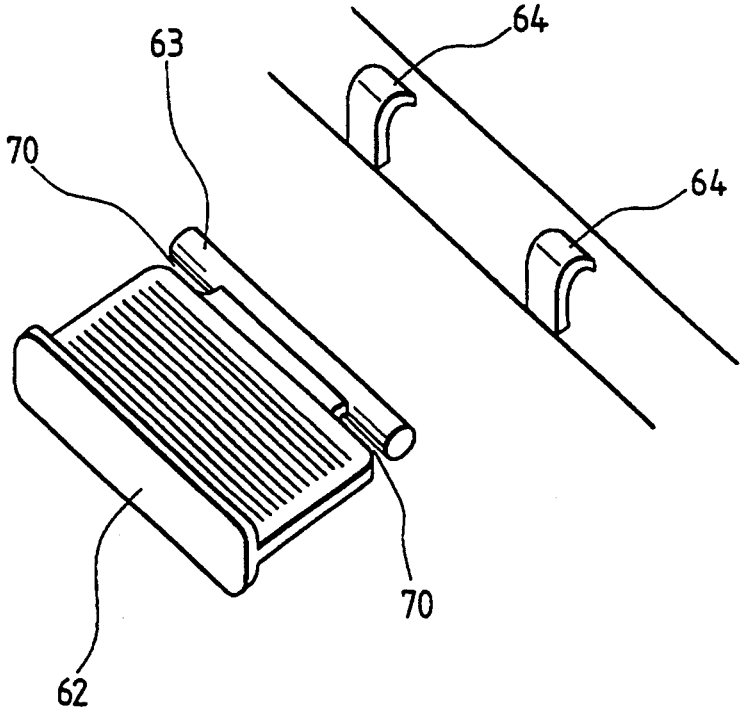
FIG. 8 is a perspective view showing a grip portion of the process cartridge.
Figure 9:
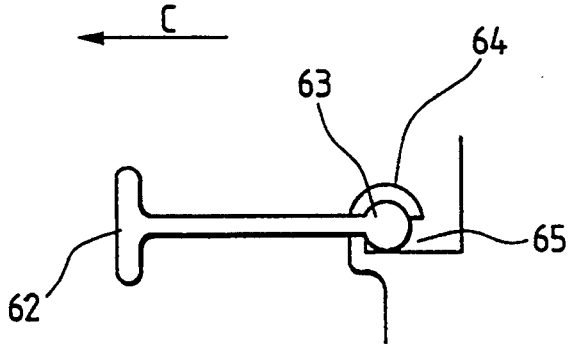
FIG. 9 is a sectional view of the grip portion.

Next, the grip member 62 of the cartridge 3 will be fully described with reference to FIGS. 8 and 9.

A shaft 63 as a pivot shaft is formed integrally with the grip member 62. Further, hinge portions 64 are formed on the frame of the cartridge. Each hinge portion 64 defines an opening or slit 65, and the grip member 62 is attached to the cartridge by inserting the shaft 63 into the openings 65 of the hinge portions 64. A dimension of the opening 65 is slightly smaller than an outer diameter of the shaft 63 so that the grip member can be snappingly attached to the cartridge. In a condition that the grip member is attached to the cartridge, the grip member 62 can be lightly pivoted around the hinge portions 64. When the cartridge 3 is dismounted from the printer, the operator may grasp the grip member 62 and pull it to a direction shown by the arrow C (FIGS. 4 and 9). In this case, since the openings 65 are directed toward a direction opposite to the direction C, the grip member 62 is prevented from disengaging from the cartridge frame inadvertently.

Figure 10:
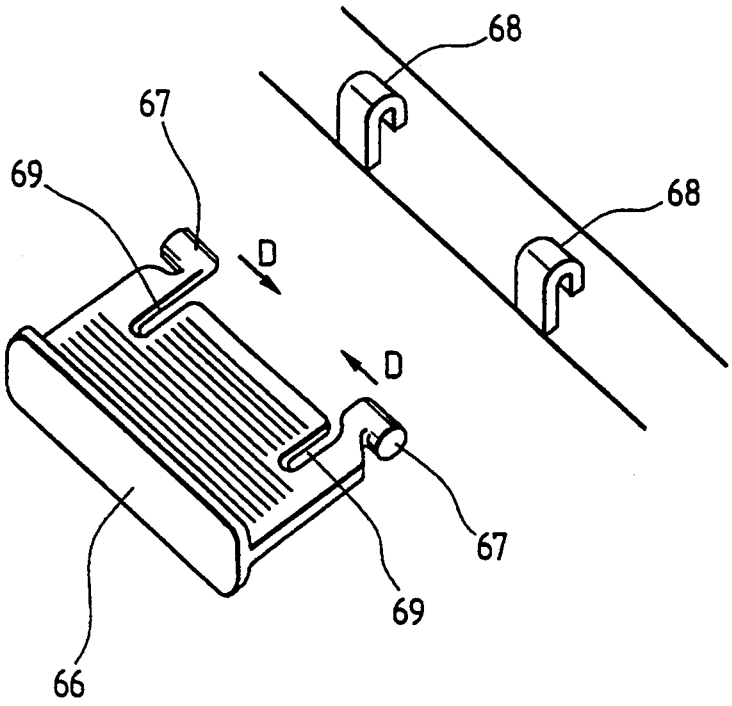
FIG. 10 is a perspective view showing an alteration of a grip portion of the process cartridge.
Figure 11:
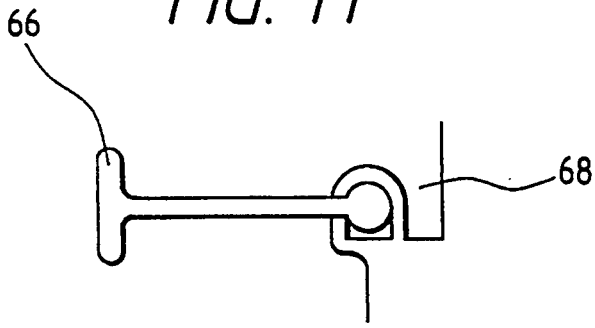
FIG. 11 is a sectional view of the grip portion of FIG. 10.

FIGS. 10 and 11 show an alteration.

In this alteration, a grip member 66 is provided with shaft portions 67 integrally formed therewith. Further, since slits 69 are formed in the grip member, the shaft portions 67 can be deflected inwardly (directions shown by the arrows D) (within a range of elastic deformation of resin material). When the grip member is attached to hinge portions 68 of the cartridge frame, the shaft portions 67 are fitted into the corresponding hinge portions 67 while elastically deforming the shaft portions toward the directions D. After the shaft portions have been fitted into the hinge portions, since the shaft portions are restored to the original positions by their elasticity, the shaft portions are not disengaged from the hinge portions. In this alteration, since there are no grooves 70 in the grip member as shown in FIG. 8, more accurate hinge connection can be achieved.

In this way, since the grip member is formed independently from the cartridge frame and can be slightly pivoted around the shaft portion(s) by inserting the shaft portion(s) into the hinge portions of the cartridge frame, the following advantages can be obtained:

(1) The grip member can support a cartridge having a greater weight;

(2) The assembling of the grip member can be facilitated and, since the grip member can easily be pivoted and there is no restoring force, the operability for packing the cartridge can be improved and there is no risk of damage of the package material; and (3) When the cartridge is inserted into the printer and the front cover is closed, the drum shutter is pivoted in response to the closing movement of the front cover to easily lift the grip member. Thus, the drum cover is not damaged because of the easy pivotal movement of the grip member.

Next, the positioning of the process cartridge in the mounting and dismounting of the cartridge will be fully explained.

As shown in FIG. 2, a projection 71 which defines an engagement portion adapted to be engaged by a cartridge insertion guide portion formed in the printer with a projection/recess connecting fashion and which is formed on at least one longitudinal end of the cartridge, and a second surface 73 which is substantially in parallel with a side surface 72 of the projection 71 and which is adapted to engage by the guide portion of the printer are formed on the longitudinal end of the cartridge. In this embodiment, the second surface 73 is defined by a side surface of a rib 74. The second surface 73 extends from a leading end (position shown by a in FIG. 2) of the cartridge insertion direction C to a trailing end thereof, and the projection 71 extends from substantially a central position (shown by b in FIG. 2) to the trailing end thereof.

Figure 12:
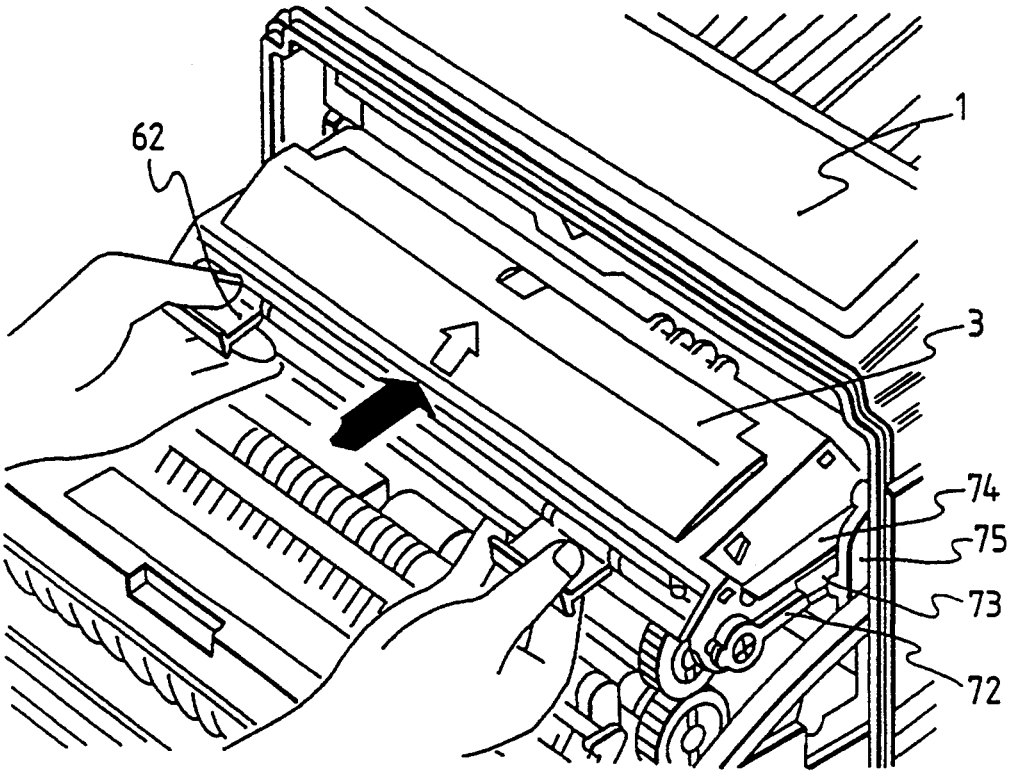
FIG. 12 is a perspective view showing a condition that the process cartridge is being mounted within the image forming apparatus.
Figure 13:
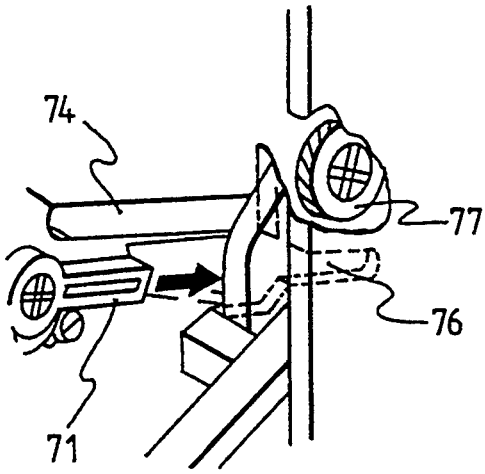
FIG. 13 is an enlarged view showing a portion of the process cartridge and a guide portion of the image forming apparatus.

With this arrangement, as shown in FIGS. 12 and 13, when the cartridge is being inserted into the printer, the second surface 73 is firstly inserted along an inner surface of the cartridge insertion guide 75 of the printer 1 which corresponds to the configuration of the cartridge, thereby positioning the cartridge in its longitudinal direction. Then, since the projection 71 is inserted along the guide 75, the insertion direction of the cartridge is determined.

In this way, since the longitudinal direction and the insertion direction of the cartridge are not determined simultaneously but the longitudinal direction thereof alone is determined and thereafter the insertion direction thereof is determined, the inserting operability for the cartridge can be improved.

Incidentally, as shown in FIGS. 12 and 13, when the projection (guide rib) 71 is inserted into a hole of the guide 75 of the printer, the drum gear (described later) of the cartridge is engaged by the drum drive gear 77.

Figure 14:
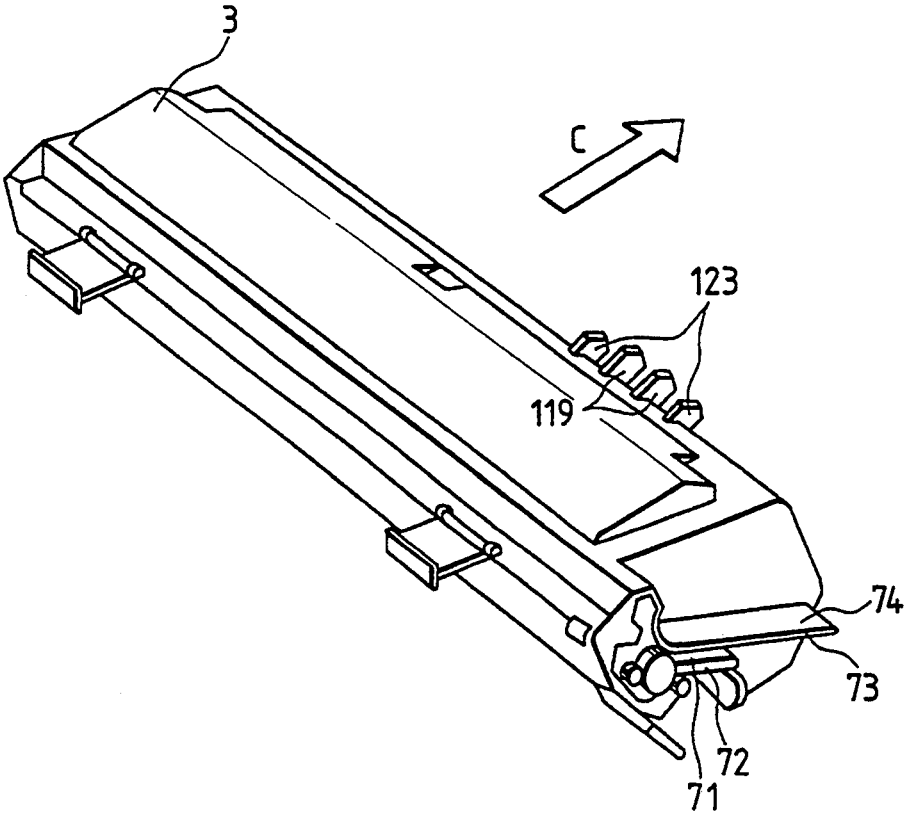
FIG. 14 is a perspective view showing another example of a cartridge.

Further, the rib 74 may be configurated as shown in FIG. 14 so long as it has the second surface 73.

Figure 15:
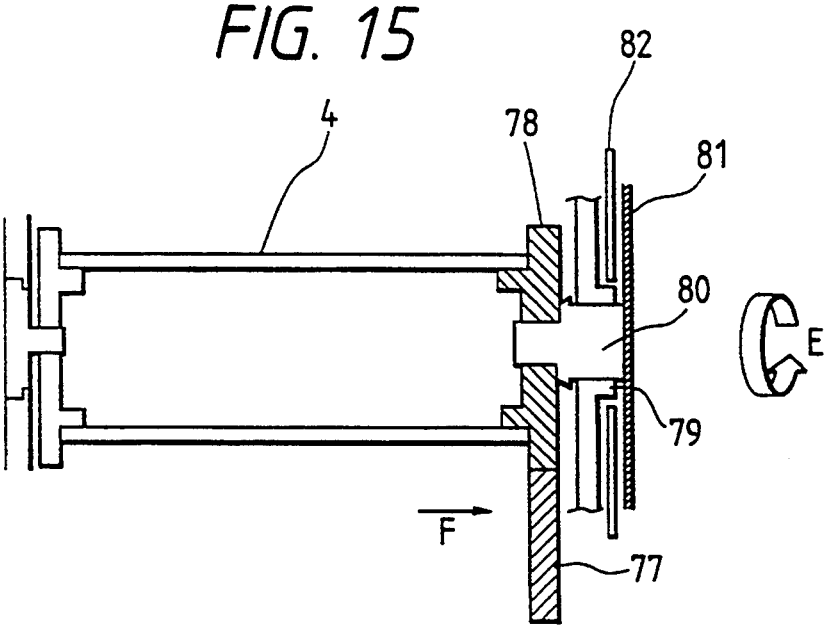
FIG. 15 is a sectional view of a photosensitive drum supporting portion of the cartridge.

Next, the positioning between the photosensitive drum and the printer will be fully explained with reference to FIG. 15.

When the drum gear 78 secured to the photosensitive drum 4 is rotated in a direction shown by the arrow E by the drum drive gear 77, since the drum gear 78 is a herical gear, a thrust force directed to a direction shown by the arrow F is generated. Thus, the flange portions 79 of the process cartridge 3 and a drum positioning pin 80 inserted into the drum gear 78 are shifted to the direction F together with the photosensitive drum 4. As a result, a surface of the drum positioning pin 80 is closely contacted with a positioning side plate 81 of the printer. Consequently, when the drum 4 is driven, the torsion between the drum 4 and the printer due to the lowering of the drum does not occur, thus correctly positioning the photosensitive drum 4 with respect to the printer. Therefore, it is possible to maintain the image quality with high accuracy. Incidentally, the reference numeral 82 denotes the frame of the cartridge.

Next, a further embodiment utilizing a similar principle will be described with reference to FIG. 16.

Figure 16:
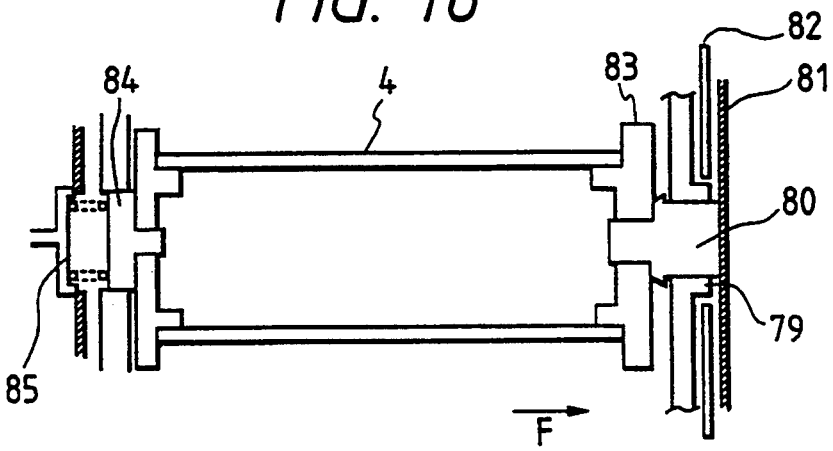
FIG. 16 is a sectional view of a photosensitive drum supporting portion of another cartridge.

In FIG. 16, when a drum gear 83 secured to the photosensitive drum 4 is a spur wheel, the photosensitive drum 4 is biased toward a thrust direction F, via a photosensitive drum positioning pin 84 at the other end of the drum, by an elastic force of a spring 85 of the printer to directly urge the photosensitive drum against the drum positioning pin 84 at the other end of the drum 4, thereby closely contacting the surface of the drum positioning pin 80 against the positioning plate of the printer. In this way, the photosensitive drum 4 can be correctly positioned with respect to the printer.

Figure 17:
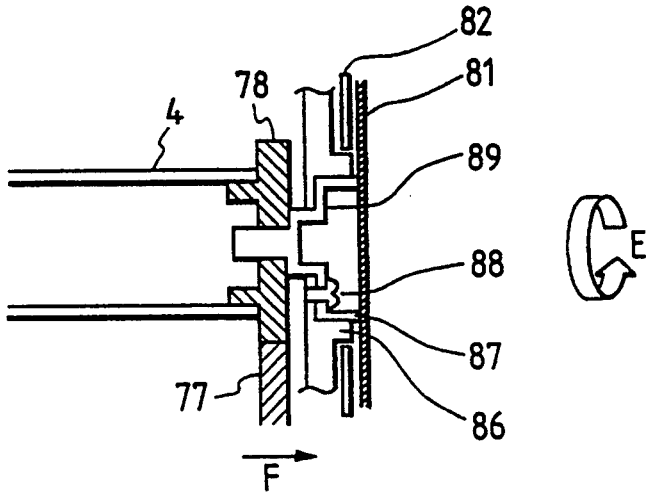
FIG. 17 is a sectional view of a photosensitive drum supporting portion of a further cartridge; 20

A still further embodiment is shown in FIG. 17.

In FIG. 17, when a positioning pin 87 inserted into the drum gear 78 secured to the photosensitive drum 78 and a flange portion 86 of the process cartridge 3 is secured to the flange portion 86 by a screw 88 only at one point, the positioning pin 87 is slightly floating from the flange portion 86 near a zone 89 because of the one point connection therebetween. Accordingly, when the thrust force is generated, the positioning pin 87 can be closely contacted with the positioning plate 81 of the printer, thereby correctly positioning the photosensitive drum 4 with respect to the printer. Further, by using the one point connection, the positioning pin can be prevented from escaping from the flange portion during the transportation of the cartridge.

Figure 18:
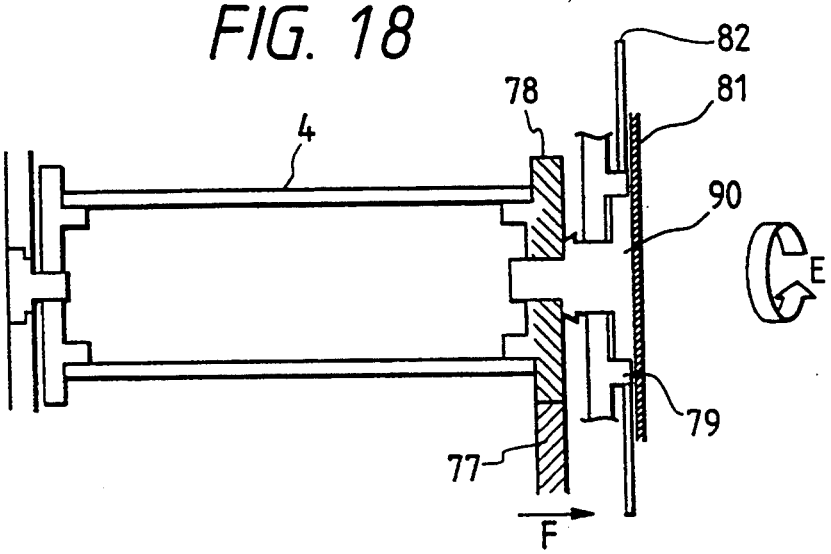
FIG. 18 is a sectional view of a photosensitive drum supporting portion of a still further cartridge.

Alternatively, as shown in FIG. 18, by increasing an outer surface of a drum positioning pin 90 as great as possible, even when the photosensitive drum 4 is driven, the lowering of the drum can effectively be prevented, thus positioning the photosensitive drum with respect to the printer further correctly.

Figure 19:
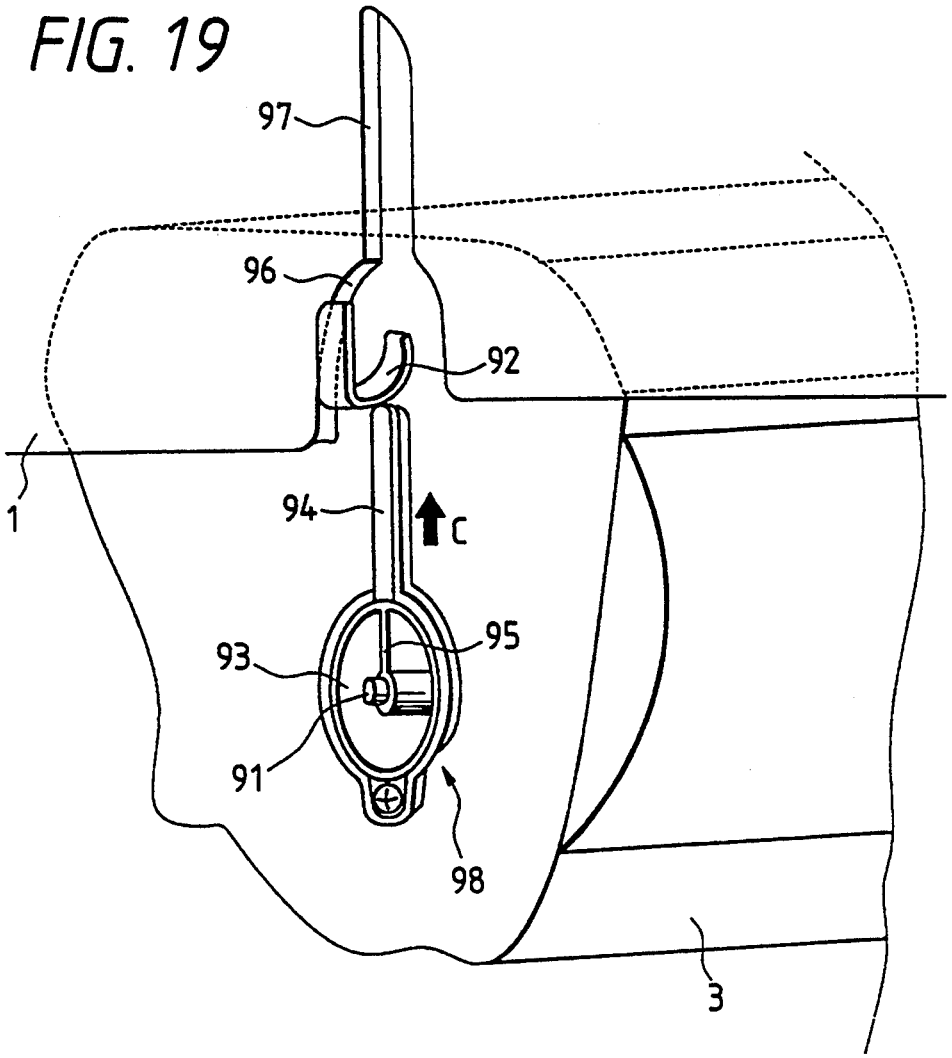
FIG. 19 is an explanatory view showing a portion of the cartridge and a drum earthing portion of the image forming apparatus.

Next, a drum earthing electrode 91 of the process cartridge 3 and a drum earthing high voltage contact 92 of the image forming apparatus 1 and therearound will be fully described with reference to FIG. 19.

A drum earthing electrode ( rotary shaft 91 ) comprising a conductive parallel pin is inserted into a center of a drum positioning pin disposed at the non-drive side of the process cartridge 3. This rotary shaft 91 is protruded from the longitudinal end of the cartridge. Around the rotary shaft 91, a recess 93 is formed (in order to save material). A rib (protecting portion) 95 is formed in the recess 93 along a line connecting a guide rib 94 for guiding the mounting of the process cartridge 3 within the printer 1 and the drum earthing electrode 91. The guide rib 94 is disposed at an end of the cartridge opposite to the cartridge end shown in FIG. 2. Further, the drum earthing high voltage contact (biasing member) 92 is attached to the printer 1 near a positioning portion 96 for the process cartridge 3.

Accordingly, when the guide rib 94 of the process cartridge 3 is inserted into a guide slot 97 of the printer along a direction shown by the arrow C, the drum earthing high voltage contact 92 of the printer 1 is firstly slid on the guide rib 94 of the process cartridge 3 and then is slid on the rib 95 of the positioning portion 98, and is surely contacted with the drum earthing electrode 91 when the positioning pin 91 is positioned in the positioning portion 96 of the printer 1. Thus, the drum earthing high voltage contact of the printer is not caught by the recess 93 around the drum positioning pin 91 of the cartridge 3 and is surely contacted with the drum earthing electrode.

Figure 20:
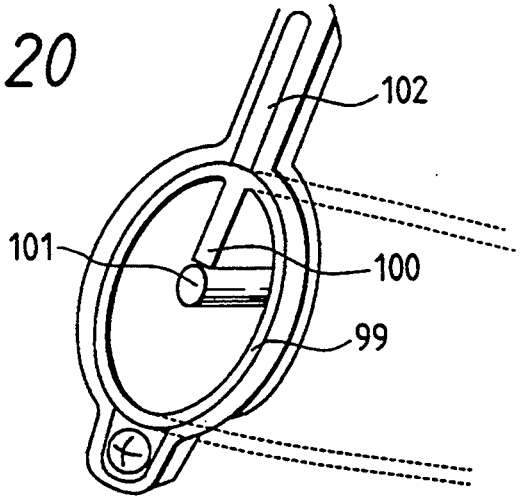
FIG. 20 is an explanatory view showing a drum earthing portion for another cartridge.

A further embodiment will be explained with reference to FIG. 20.

In the previous embodiment, there was a step between the rib of the drum positioning pin and the drum earthing electrode. However, in this embodiment, as shown in FIG. 20, a height of one end (near a drum earthing electrode 101) of a rib 100 of a drum positioning pin 99 is same as that of the drum earthing electrode 101, and a height of the other end of the rib 100 is same as that of a guide rib 102 so that the rib 100 is smoothly inclined. Thus, when the process cartridge is mounted within the printer, the drum earthing high voltage contact (not shown) of the printer is slid on the guide rib of the process cartridge 3 and the rib of the drum positioning pin 99, thereby contacting with the drum earthing electrode 101 more smoothly without riding over any step.

Next, a method for supporting the photosensitive drum will be explained with reference to FIG. 21. Incidentally, although FIG. 21 shows a method for supporting one end of the photosensitive drum, the other end of the photosensitive drum may be supported by the same method.

Figure 21:
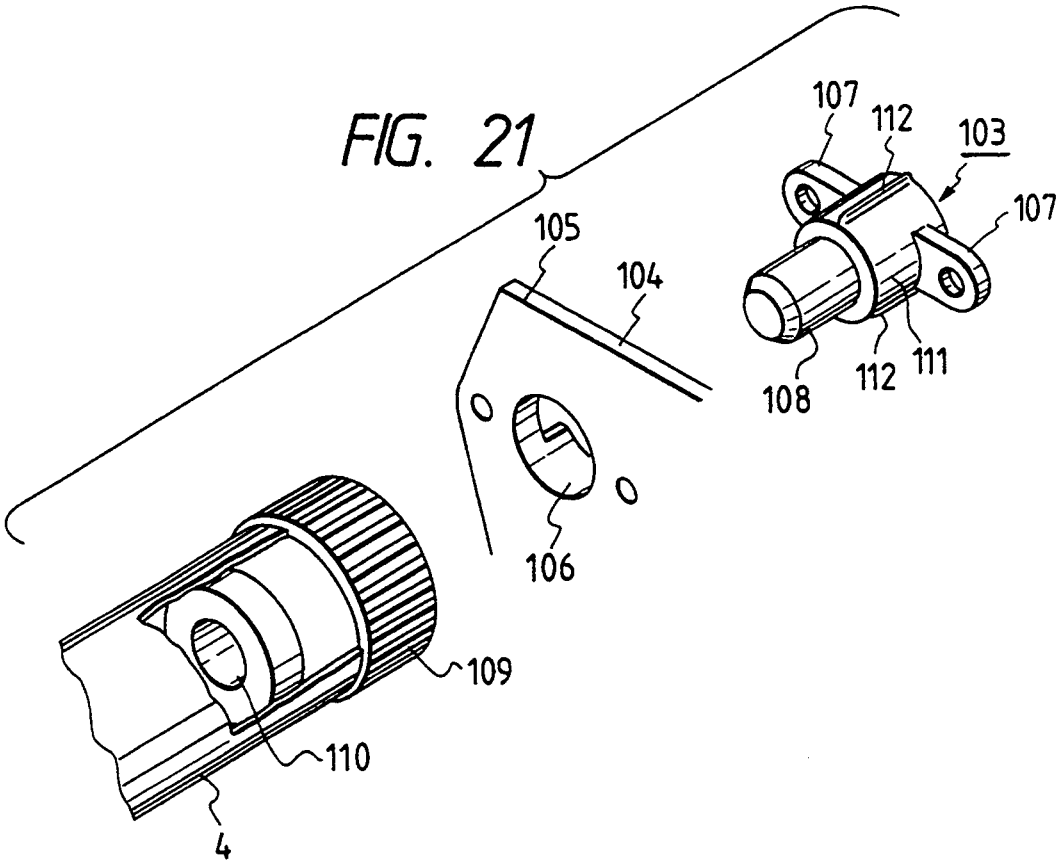
FIG. 21 is an exploded perspective view of a drum supporting portion of the cartridge.

In FIG. 21, a drum support shaft 103 is fitted into a fitting hole 106 formed in an arm portion 105 extending from a cleaner container 104 which forms a part of the frame of the process cartridge, and is secured to the arm portion via flange portions 107 and screws (not shown) passing through the flange portions.

A boss portion 108 of the drum support shaft 103 is engaged by a central bore 110 formed in a flange gear 109 secured to the end of the photosensitive drum 4 by adhesive, press-fit, caulking or the like, so that the photosensitive drum can be rotated. Incidentally, the drum support shaft 103 is made of self-lubricating plastic such as polyacetal, so that the drum 4 can be smoothly rotated due to the relative sliding rotation between the bore 110 of the flange gear 109 and the boss portion 108. Further, the boss portion 108 of the drum support shaft 103 is clearance-fitted into the bore 110 of the gear flange 109 for permitting such sliding rotation.

On the other hand, three longitudinal ribs (projections) 112 are formed on a main diameter portion 111 of the drum support shaft 103 and are spaced apart from each other in a circumferential direction, and a diameter of a circle contacting with top surfaces of the ribs is greater than an inner diameter of the fitting hole 106 of the arm portion 105 of the cleaner container into which the main diameter portion is fitted, by about 0.05–0.3 mm. Further, the inner diameter of the fitting hole 106 is greater than an outer diameter of the main diameter portion 111 of the shaft 103 (However, the maximum difference in diameter is smaller than 0.05 mm). Accordingly, since the shaft 103 is press-fitted into the fitting hole 106 at three points (corresponding to the ribs 112), when the drum 4 is attached to the frame or casing of the cartridge, the drum support shaft 103 is press-fitted into the fitting hole 106. Further, it is more preferable that the shaft 103 is secured to the arm portion 105 by screws passing through the holes of the flange portions 107. The cleaner container is made of plastic material such as denatured PP0, polycarbonate, polystyrene, ABS or the like so that, when the drum support shaft 103 is press-fitted, recesses are formed in an inner peripheral surface of the fitting hole 106 by the ribs 112. On the other hand, the ribs 112 of the drum support shaft 103 are also deformed by the press-fit. Accordingly, the inner wall of the fitting hole 106 and the ribs 112 of the drum support shaft 103 are relatively deformed to generate the reaction force, thereby firmly securing the ribs in the fitting hole without any play.

Figure 22:
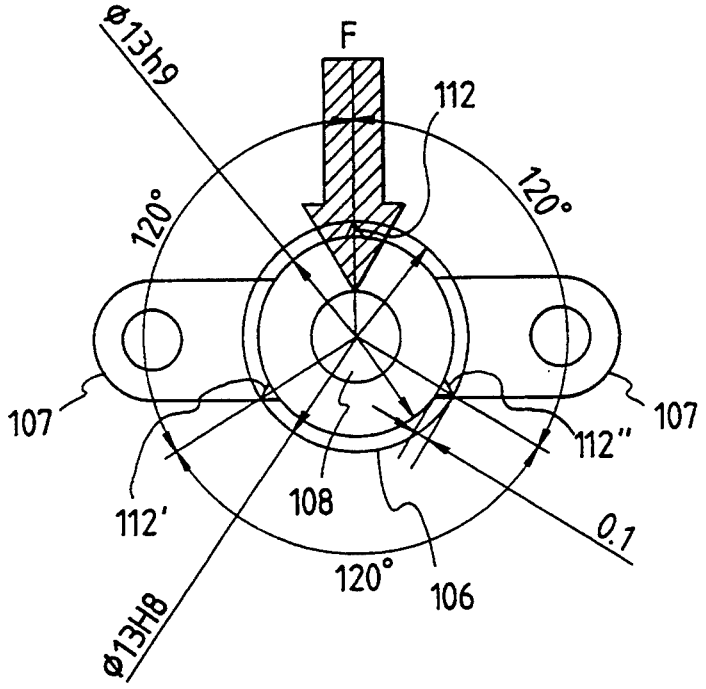
FIGS. 22 and 23 are explanatory views showing a force acting on the photosensitive drum when the latter is rotated.

The arrangement of the ribs on the main diameter portion of the drum support shaft will be explained in more detail with reference to FIGS. 22 and 23. FIG. 22 is a front view showing a condition in which the drum support shaft is press-fitted into the cleaner container, and FIG. 23 is a schematic view showing a direction of the force F.

The three ribs 112 on the main diameter portion 111 of the drum support shaft 103 are arranged equidistantly (intervals of 120 degrees). Further, although the meshing force between the drive gear 77 and the drum gear 78, the urging force of the charger roller and the abutting force of the cleaning blade act on the photosensitive drum 4, among them, the meshing force F between the drive gear and the drum gear affects the great influence upon the photosensitive drum. The force F directs to a direction deviated, toward the drum gear 78, from a common tangential line regarding a contact point between pitch circles of the drive gear 77 and the drum gear 78, by an angle corresponding to a pressure angle $\alpha$. This force F is received or supported by two ribs (112' and 112'') among the three ribs. In this way, since the force F is supported by at least two ribs, the force F is dispersed, thereby minimizing the eccentricity of the drum rotary shaft. Further, as shown in FIG. 22, since one rib 112 other than the two ribs 112', 112'' is formed on the drum support shaft, the drum support shaft 103 can be inserted into the fitting hole 106 more easily.

In this case, by selecting the outer diameter of the main diameter portion 111 of the drum support shaft 103 to o 13h9, a height of each rib 112 to 0.1 mm, and the inner diameter of the fitting hole 106 to o 13H8, it is possible to suppress the deformation of the ribs moderately. Incidentally, in consideration of the resistance generated when the shaft 103 is inserted into the hole 106, the height of each rib is preferably 0.05–0.5 mm.

If the force F acts on only one rib, the deformation of this rib will be greater than those of the other two ribs, with the result that the center of the drum will be deviated slightly. Accordingly, by arranging the ribs on the main diameter portion of the drum support shaft as mentioned above, it is possible to uniformly support the force acting on the drum support shaft, thus preventing the deviation of the drum center.

Incidentally, the cross-section of each rib 112 may be triangular, semi-circular or the combination thereof. Further, the number of the ribs 112 may be four or more so long as the force F can be supported by a plurality of ribs. In addition, a force by which the drum support shaft 103 is inserted into the fitting hole 106 is sufficient to deform the ribs 112, which force can easily be created by the operator without any pressuring tool. Furthermore, such ribs may be formed on the inner surface of the fitting hole 106. Also in this case, the same advantage can be expected.

Figure 24:
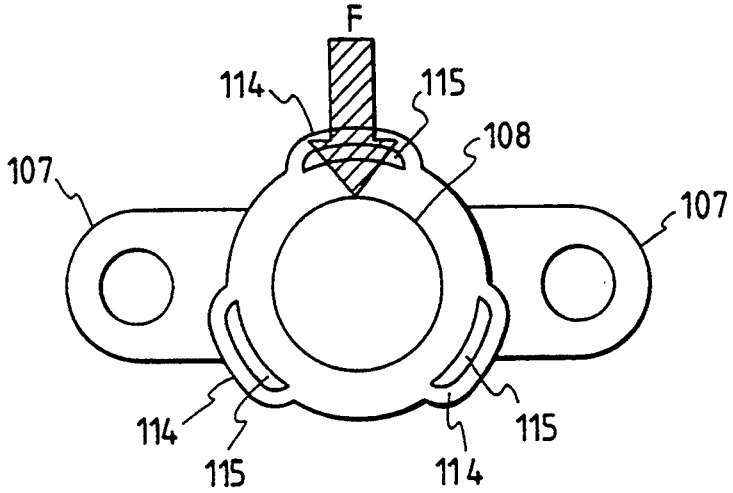
FIG. 24 is an explanatory view showing an alteration of a drum supporting portion.

FIG. 24 is a front view of a drum support shaft according to another example.

A drum support shaft 113 is fitted into the fitting hole 106 formed in the arm portion 105 extending from the cleaner container 104, and is secured to the arm portion via the flange portions 107 and screws (not shown) passing through the flange portions. The boss portion 108 of the drum support shaft is engaged by the gear flange 109 secured to the end of the photosensitive drum 4 so that the photosensitive drum 4 is rotatably supported. Three projections are formed on a main diameter portion 111 of the drum support shaft 113, and a diameter of a circle contacting with top surfaces of the projections is slightly greater than an inner diameter of the fitting hole 106 of the arm portion 105 of the cleaner container 104. Each projection is provided with an internal cavity 115 so that a thickness of a wall of the projection 114 is reduced. One of three projections 114 is positioned in a direction on which the force F acts, so that the force F is supported by the other two projections. Thus, when the drum support shaft 113 is inserted into the fitting hole 106 of the cleaner container 104, the projections 114 are deformed to collapse the cavities 115.

The drum support shaft 113 is firmly secured in the fitting hole 106 without any play, thus stabilizing the rotation of the photosensitive drum. Further, the gear flange 109 is not deformed even when it is subjected to the force F by the drive gear (not shown) of the printer in a direction of the pressure angle of the gear.

Further, also in this case, a force for inserting the drum support shaft into the fitting hole is sufficiently small, thereby facilitating the assembling of the drum.

Figure 33B:
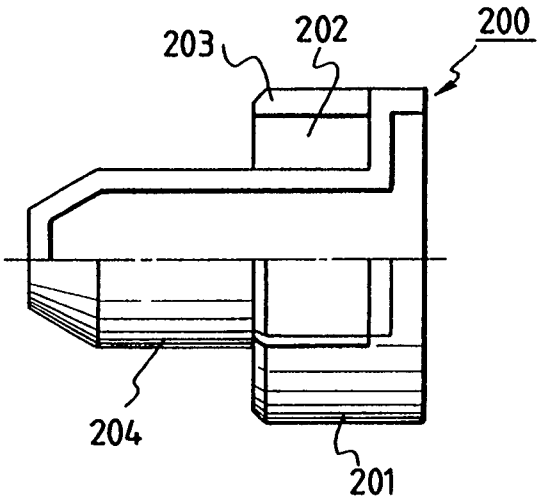
FIGS. 33A and 33B are explanatory views showing an alteration of a drum supporting portion.
Figure 33A:
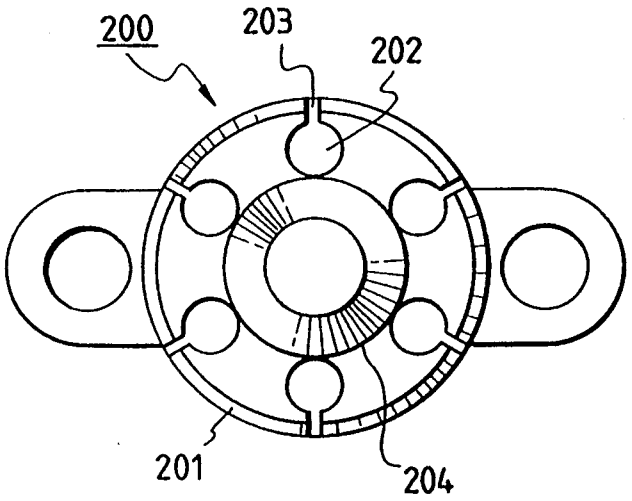

Alternatively, a drum support shaft may be constituted as shown in FIGS. 33A and 33B. In this embodiment, a drum support shaft 200 is fitted into a fitting hole 106 while deforming a main diameter portion 201 of the shaft itself. As shown in FIGS. 33A and 33B, an outer diameter of the main diameter portion 201 of the drum support shaft 200 is greater than an inner diameter of the fitting hole 106 by about 10–90 $\mu$m, and a plurality of longitudinal cavities 202 are formed in the drum support shaft along a circumferential direction thereof. Each cavity 202 extends up to the outer surface of the main diameter portion 201 through a slit 203. Accordingly, when the support shaft 200 is press-fitted into the fitting hole 106, the main diameter portion 201 is deformed to make the slits narrower. The reaction force generated due to the deformation of the slits 203 acts on the fitting hole 106, thereby firmly securing the support shaft 200 in the fitting hole 106 without any play.

Incidentally, a force for inserting the support shaft 200 into the fitting hole 106 may be small, thereby permitting the press-fit without any tool as in the previous embodiment. Further, the cavities 202 and the slits 203 may be formed in the fitting hole 106 or in both the support shaft 200 and the fitting hole 106. Also in this case, the same advantage can be expected.

Figure 25:
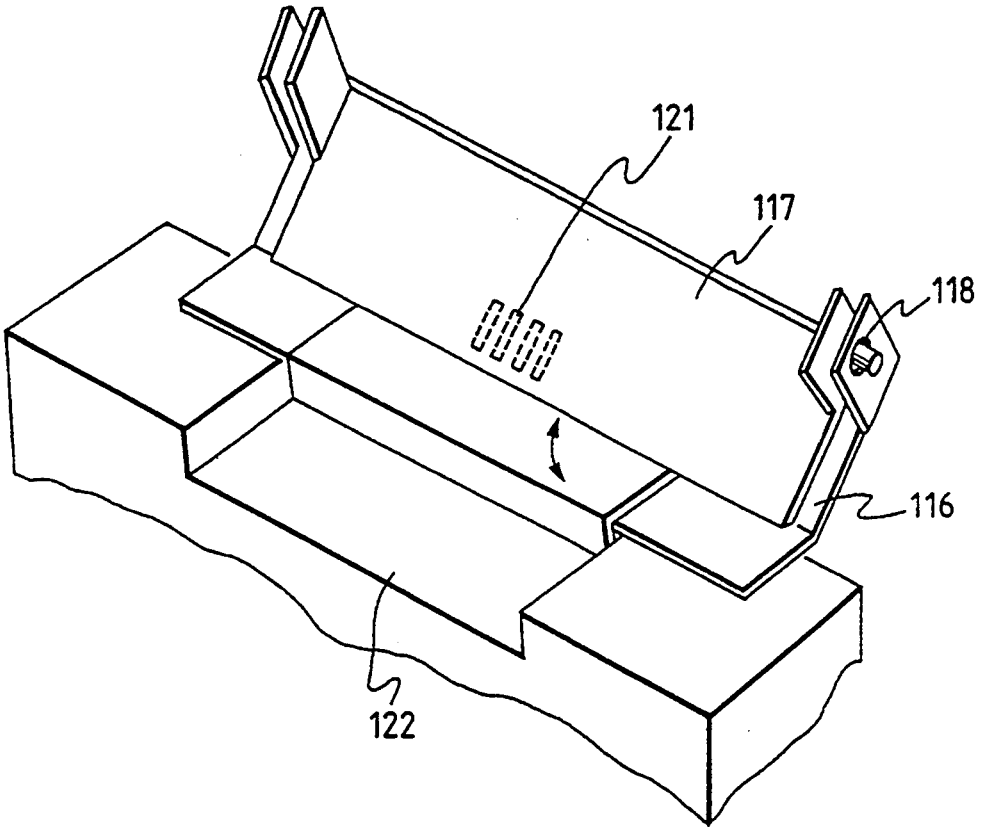
FIG. 25 is a perspective view of a laser shutter portion.

Next, an opening/closing mechanism for the laser shutter will be explained with reference to FIG. 25.

As mentioned above, the laser shutter 117 is pivotally mounted on the inner cover 116 of the printer for pivotal movement around the holes 118. When the process cartridge is not mounted within the printer, the laser shutter 117 acting as the laser path blocking means is closed downwardly by its own weight (refer to FIG. 4). Accordingly, if the laser beams should be emitted by an erroneous operation, since the laser paths are blocked, the laser beams can be prevented from leaking out of the printer.

Figure 26:
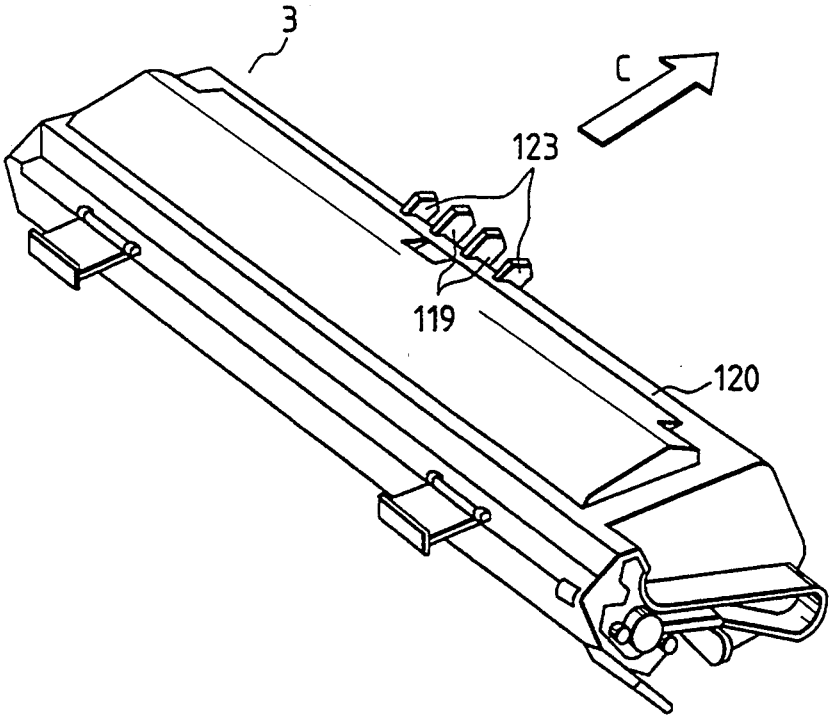
FIG. 26 is a perspective view of a cartridge.

On the other hand, as shown in FIG. 26, the laser shutter ribs (first projections) 119 for actuating the laser shutter 117 are formed on the frame 120 of the process cartridge 3 substantially at a longitudinal central zone of the cartridge to protrude from the frame 120. When the process cartridge 3 is mounted within the printer, the laser shutter ribs 119 pass through the holes 121 formed in the inner cover 116 and are abutted against the laser shutter 117 to push the latter, with the result that the laser shutter 117 is pivoted upwardly around the holes 118, thereby opening the laser beam opening 122 of the printer (also refer to FIG. 3).

Figure 27:
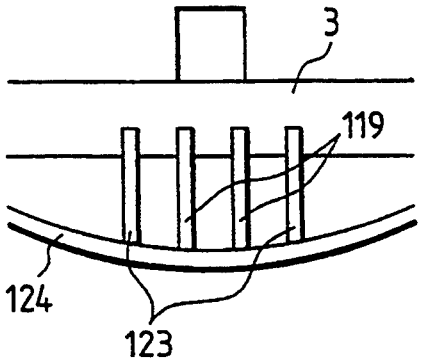
FIG. 27 is an explanatory view showing an engagement condition between laser shutter ribs of the cartridge and a package material.

By the way, on both sides of the laser shutter ribs 119, there are arranged second projections 123 which have a protruding amount less than those of the first projections 119 and are adjacent to the first projections. Thus, even if an inadvertent shock is applied to the process cartridge 3 during the storage of the process cartridge enclosed by a package bag 124, as shown in FIG. 27, since the free ends of the four projections arranged side by side are uniformly abutted against the package bag 124, it is possible to prevent the force from acting on the bag at one point, thereby preventing the bag 124 from tearing during the transportation of the process cartridge 3.

Thus, even when the toner applying ability is decreased due to the increase in the humidity of the developing toner T in the process cartridge, it is possible to prevent the reduction in the image density and/or the fog of the image. Further, since the second projections 123 are arranged on both sides of the first projections 119, the second projections serve to protect the first projections.

By the way, the protruding amount of the laser shutter rib 119 from the frame 120 is selected to have a value more than 6 mm in order to open the laser shutter 117, but is selected to have a value less than 8 mm because if the protruding amount is too great the strength of the ribs 119 themselves are reduced. Further, it should be noted that, when the cartridge is mounted within the printer, the laser beam path blocking means is abutted against the first projections, but is not abutted against the second projections.

Next, another embodiment regarding the laser shutter ribs will be explained with reference to FIG. 2.

Figure 28:
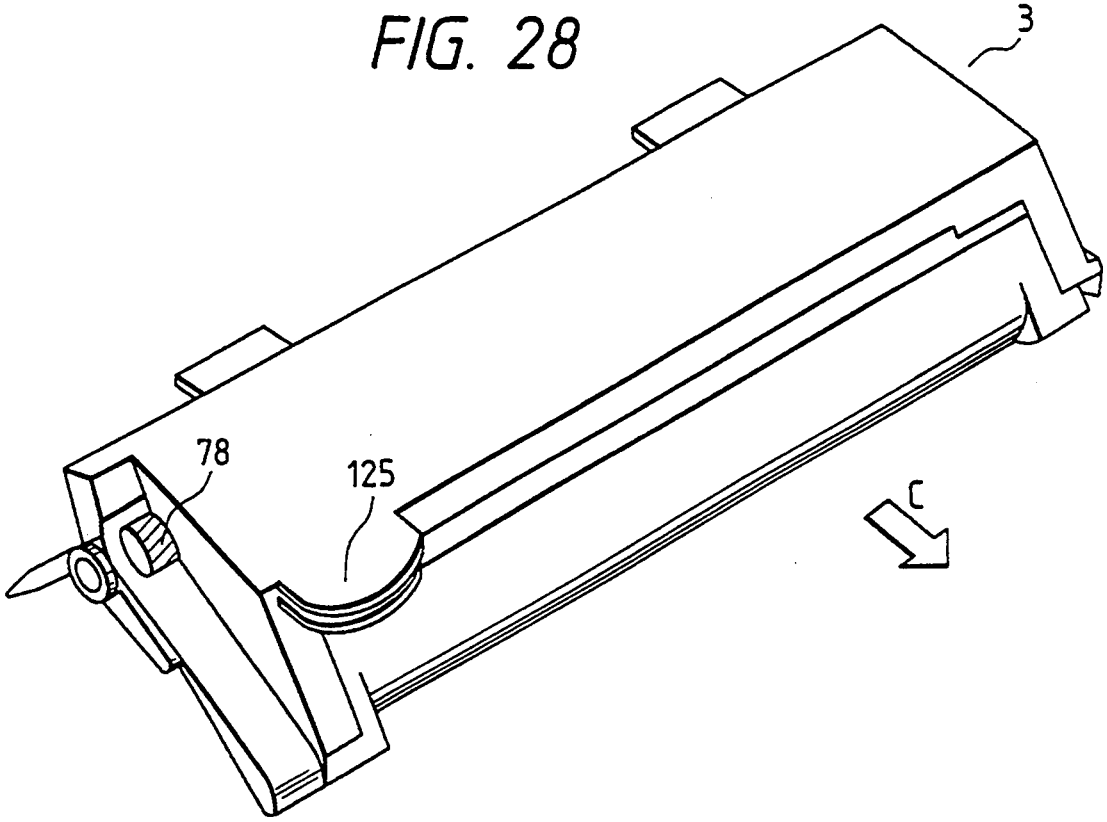
FIG. 28 is a perspective view showing an alteration of a cartridge.
Figure 29:
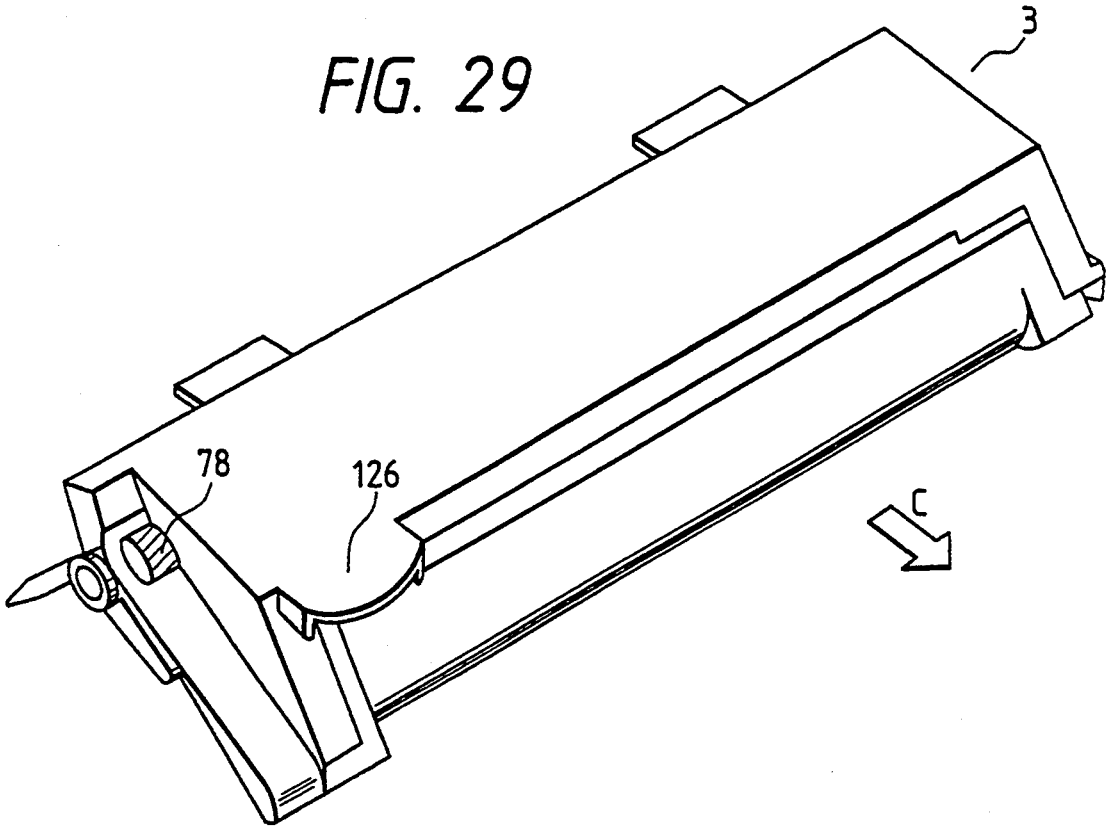
FIG. 29 is a perspective view showing a further alteration of a cartridge.

In the embodiment shown in FIG. 2, laser shutter ribs (abutment portions) 119 for abutting against the laser beam path blocking means to open the laser beam paths are arranged on the frame of the process cartridge offset from the longitudinal central position of the cartridge toward the drum gear (driving force receiving portion) 78 (The drum gear 78 is arranged at the right end (FIG. 2) of the cartridge to be engaged by the drive gear 77 of the printer) (also refer to FIGS. 28 and 29). Thus, when the drum gear 78 is subjected to the driving force from the drive gear 77 of the printer, since the force F as shown in FIG. 23 is generated, even when the cartridge is not fully inserted into the printer, the cartridge is brought to the predetermined mounting position by the force F. Consequently, the risk that the image formation is effected with the imperfect opening of the laser shutter can be avoided.

Further, if the weight of the laser shutter is great, the process cartridge can be brought to the proper mounting position in the printer by the meshing force F overcoming the weight of the shutter, thereby surely opening the laser shutter. Incidentally, it should be noted that the holes through which the laser shutter ribs pass are formed in the inner cover of the printer in correspondence to the laser shutter ribs.

Next, a further embodiment regarding the laser shutter ribs will be explained with reference to FIG. 28.

In this embodiment, as shown in FIG. 28, ribs 125 extending in a longitudinal direction of the cartridge are formed on the frame of the cartridge. Two ribs 125 are arranged side by side in a vertical direction, and each rib has a semi-circular free end against which the package bag 124 can be abutted. Thus, it is possible to prevent the package bag from tearing. Further, since the ribs extend along the longitudinal direction of the process cartridge 3, the frame of the cartridge can be reinforced by the ribs.

Next, a still further embodiment regarding the laser shutter rib with reference to FIG. 29. In FIG. 29, a laser shutter rib 126 has an inverted U-shaped configuration. Also in this case, it is possible to prevent the package bag from tearing.

Further, since the rib has the inverted U-shaped configuration, when the laser shutter rib is abutted against the laser shutter, the deformation of the rib due to the weight of the laser shutter can be prevented.

The other embodiment regarding the laser shutter rib will be explained with reference to FIG. 30.

Figure 30:
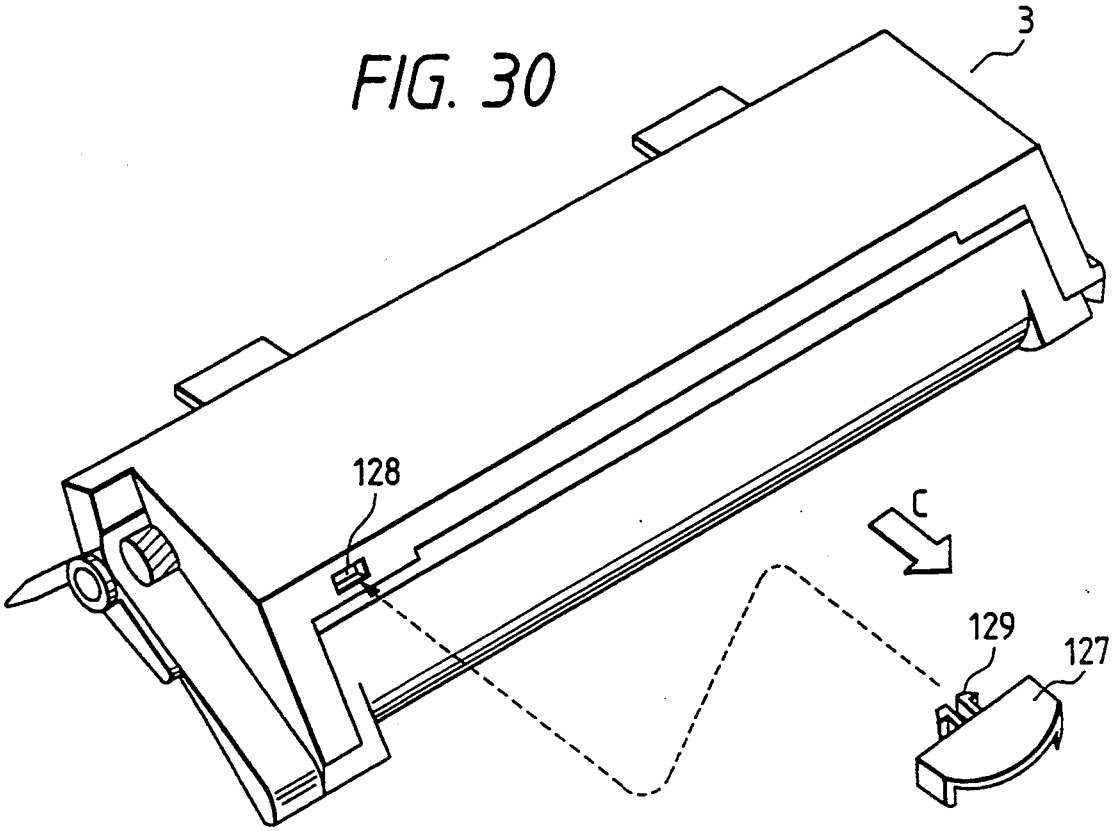
FIG. 30 is a perspective view showing a still further alteration of a cartridge.

In FIG. 30, a laser shutter rib 127 is formed independently from the frame of the cartridge. In this case, a hole 128 is formed in the frame of the cartridge, and a snap fit 129 is formed on the laser shutter rib 127. Thus, by inserting the snap fit 129 into the hole 128, the laser shutter rib 127 is integrally attached to the cartridge frame. In this embodiment, the following advantages can be obtained.

Regarding the printer or image forming apparatus, several kinds of process cartridges having the same external appearance, such as a cartridge including toner having small toner particle size of about 5–6 μm, a cartridge including toner having toner particle size of about 15 μm and the like are prepared. Among them, the proper process cartridge is used in accordance with the specification (for example, high quality fine image, high speed print or the like) of the image forming apparatus. In this embodiment, since the drum shutter rib 127 is formed independently from the cartridge frame, by changing the configuration or height of the drum shutter ribs, the process cartridges can be discriminated.

As mentioned above, according to the present invention, a process cartridge comprising a rotary member, holding members for rotatably holding the rotary member, a driving force receiving portion provided on the rotary member and adapted to receive a driving force from an image forming apparatus, and securing portions for securing the holding members in fitting holes formed in a frame of the cartridge, and wherein the fixing member comprises a plurality of projections provided on an outer peripheral surface of the holding member and arranged at positions where a force acting on the rotary member due to the driving force from the image forming apparatus can be supported by the projections. Whereby, even when the rotary member (image bearing member) is rotated, the deviation or deflection of a central axis of the rotary member from a predetermined position can be minimized.

What is claimed is:

1. A process cartridge mountable within an image forming apparatus, comprising:

a frame;

a fitting hole formed in said frame;

an image bearing member;

process means acting on said image bearing member;

a support shaft fitted into said fitting hole for rotatably supporting said image bearing member; and a projection formed on at least one of an outer peripheral surface of said support shaft and an inner surface of said fitting hole.

2. A process cartridge according to claim 1, wherein said projection has an elongated configuration extending in a fitting direction of said support shaft.

3. A process cartridge according to claim 1, wherein, when said support shaft is fitted into said fitting hole, said projection is partially deformed.

4. A process cartridge according to claim 1, wherein a plurality of said projections are provided at positions where said projections can support a force generated when said image bearing member receives a driving force from said image forming apparatus.

5. A process cartridge according to claim 1, wherein three projections are arranged on the outer peripheral surface of said support shaft and are equidistantly disposed in a circumferential direction of said support shaft with an interval of 120 degrees.

6. A process cartridge according to claim 1, wherein said fitting hole is formed from plastic material such as denatured PPO, polycarbonate, polystyrene or the like.

7. A process cartridge according to claim 1, wherein said projection is integrally molded with said support shaft by plastic material such as polyacetal or the like.

8. A process cartridge according to claim 1, wherein a protruding amount of said projection is about 0.05 mm—about 0.5 mm.

9. A process cartridge according to claim 1, wherein said image bearing member comprises a photosensitive drum which is engaged, at its inner peripheral surface, by the outer peripheral surface of said support shaft to be supported by said support shaft.

10. A process cartridge according to claim 1, wherein said process means comprises charger means for charging a photosensitive drum as said image bearing member.

11. A process cartridge according to claim 1, wherein said process means comprises developing means for developing a latent image formed on a photosensitive drum as said image bearing member.

12. A process cartridge according to claim 1, wherein said process means comprises cleaning means for removing residual toner remaining on a photosensitive drum as said image bearing member.

13. A process cartridge according to claim 1, wherein the process cartridge integrally incorporates therein charger means, developing means or cleaning means as said process means, and an electrophotographic photosensitive member as said image bearing member, as a unit which can be removably mounted within said image forming apparatus.

14. An image forming apparatus within which a process cartridge can be mounted for forming an image on a recording sheet, comprising:

mounting means capable of mounting a process cartridge including a frame, a fitting hole formed in said frame, an image bearing member, process means acting on said image bearing member, a support shaft fitted into said fitting hole for rotatably supporting said image bearing member via said frame, and at least one projection formed on at least one of an outer peripheral surface of said support shaft and an inner surface of said fitting hole;

driving force transmitting means for transmitting a driving force to said image bearing member of said process cartridge mounted on said mounting means; and convey means for conveying a recording sheet.

15. An image forming apparatus according to claim 14, wherein said projection has an elongated configuration extending in a fitting direction of said support shaft.

16. An image forming apparatus according to claim 14, wherein the image forming apparatus is an electrophotographic copying machine.

17. An image forming apparatus according to claim 14, wherein the image forming apparatus is a laser beam printer.

18. A method for assembling a photosensitive drum to a process cartridge, wherein said process cartridge includes a frame, a fitting hole formed in said frame, and a photosensitive drum, said method comprising the steps of:

forcibly fitting a support shaft into said fitting hole, at least one of an outer surface of said support shaft and an inner surface of said fitting hole having at least one projection; and rotatably supporting said photosensitive drum by said support shaft.

19. A method according to claim 18, wherein said projection has an elongated configuration extending in a fitting direction of said support shaft.

20. A method according to claim 18, wherein, when said support shaft is fitted into said fitting hole, said projection is partially deformed.

21. A method according to claim 18, wherein a plurality of said projections are provided at positions where said projections can support a force generated when said image bearing member receives a driving force from an image forming apparatus.

22. A method according to claim 18, wherein three projections are arranged on the outer peripheral surface of said support shaft and are equidistantly disposed in a circumferential direction of said support shaft with an interval of 120 degrees.

23. A method according to claim 18, wherein, after said support shaft is fitted into said fitting hole, a member integral with said support shaft is secured to said frame by screw means.

24. A process cartridge mountable within an image forming apparatus having a first driving force transmitting gear for rotating an image bearing drum, comprising:

an image bearing drum having a second gear which is meshed with said first gear when the process cartridge is mounted within said image forming apparatus;

a support shaft for rotatably supporting said drum; and a casing having a fitting hole for nonrotatably receiving said support shaft;

wherein a plurality of projections are formed on at least one of an outer peripheral surface of said support shaft and an inner surface of said fitting hole, said projections being adapted to prevent the eccentricity of said support shaft fitted into said fitting hole when said first gear is rotated to drive said second gear of the process cartridge mounted within said image forming apparatus.

25. A process cartridge according to claim 24, wherein an inner diameter of said fitting hole is greater than a diameter of the outer peripheral surface of said support shaft inserted into said fitting hole.

26. An image forming apparatus according to claim 24, wherein at least two of said plurality of projections are provided at a position where they receive a force F generated by rotation of said first and second gears.

27. An image forming apparatus according to claim 26, wherein the force F acts in the direction making an angle equal to a pressure angle toward said second gear with respect to a common tangential line of said first and second gears.

28. A supporting device for rotatably supporting an image bearing member within a process cartridge having a fitting hole, said supporting device, comprising:

a first portion rotatably supporting the image bearing member; and a second portion engaging the fitting hole of the process cartridge and having at least one projection formed on a peripheral surface thereof.

29. A supporting device according to claim 28, wherein said second portion has a plurality of projections arranged equidistantly on the peripheral surface thereof.

30. A supporting device according to claim 28, wherein at least one of projections has an elongated configuration extending in a fitting direction of said device.

31. A supporting device according to claim 28, further comprising a screw hole for fixing said device to a frame of the process cartridge.

* * * * *

UNITED STATES PATENT AND TRADEMARK OFFICE

CERTIFICATE OF CORRECTION

PATENT NO. : 5,452,056

DATED : September 19, 1995

INVENTOR(S) : Yoshiya NOMURA, et al.

It is certified that error appears in the above-indentified patent and that said Letters Patent is hereby corrected as shown below:

COLUMN 1:

Line 44, "an" should read --a--

Line 43, "a" (second occurrence) should read --an--; and

Line 51, "are" should be deleted.

COLUMN 3:

Line 35, "cartridge; 20 Fig. 18" should read "cartridge; ¶Fig. 18--.

COLUMN 4:

Line 4, "will" should read --will be--.

COLUMN 5:

Line 56, "to" should be deleted.

UNITED STATES PATENT AND TRADEMARK OFFICE

CERTIFICATE OF CORRECTION

PATENT NO. : 5,452,056

DATED : September 19, 1995

INVENTOR(S) : Yoshiya NOMURA, et al.

It is certified that error appears in the above-indentified patent and that said Letters Patent is hereby corrected as shown below:

COLUMN 7:

Line 52, "a" should read --an--.

COLUMN 10:

Line 40, "line Z" should read --line ℓ--.

COLUMN 15:

Line 4, "103" should read --103.--;
Line 54, "0" should read --∅--.
Line 55, "o" should read --ø--.

UNITED STATES PATENT AND TRADEMARK OFFICE

CERTIFICATE OF CORRECTION

PATENT NO. : 5,452,056

DATED : September 19, 1995

INVENTOR(S) : Yoshiya Nomura, et al.

It is certified that error appears in the above-indentified patent and that said Letters Patent is hereby corrected as shown below:

COLUMN 22:

Line 5, "device," shouild read --device--;
Line 16, "projections" should read --said projections--.

Signed and Sealed this

Thirtieth Day of January, 1996

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,452,056

DATED : September 19, 1995

INVENTOR(S) : Yoshiya NOMURA, et al.

It is certified that error appears in the above-indentified patent and that said Letters Patent is hereby corrected as shown below:

COLUMN 17:

Line 53, "are" should read --is--.

Signed and Sealed this

Twelfth Day of March, 1996

Bruce Lehman

*Attest:*

BRUCE LEHMAN

*Attesting Officer*

*Commissioner of Patents and Trademarks*